US008953973B2

(12) United States Patent
Aiba et al.

(10) Patent No.: US 8,953,973 B2
(45) Date of Patent: Feb. 10, 2015

(54) IMAGE FORMING APPARATUS WITH CLEANING BLADE

(71) Applicant: Canon Kabushiki Kaisha, Tokyo (JP)

(72) Inventors: Shozo Aiba, Tsukubamirai (JP); Motohiro Ogura, Kashiwa (JP); Takashi Ueno, Tokyo (JP); Kengo Sato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 13/772,648

(22) Filed: Feb. 21, 2013

(65) Prior Publication Data

US 2013/0223872 A1 Aug. 29, 2013

(30) Foreign Application Priority Data

Feb. 28, 2012 (JP) ..... 2012-041284
Feb. 13, 2013 (JP) ..... 2013-025455

(51) Int. Cl.
*G03G 15/16* (2006.01)
*G03G 21/00* (2006.01)

(52) U.S. Cl.
CPC ..... *G03G 21/0011* (2013.01); *G03G 15/161* (2013.01); *G03G 2215/1661* (2013.01)
USPC ..... 399/101

(58) Field of Classification Search
CPC ..... G03G 15/161; G03G 15/168; G03G 2215/1661
USPC ..... 399/98, 101, 129
See application file for complete search history.

(56) References Cited

U.S. PATENT DOCUMENTS

| | | | | |
|---|---|---|---|---|
| 7,289,759 | B2 | 10/2007 | Ogura | |
| 7,343,133 | B2 | 3/2008 | Ueno | |
| 7,764,917 | B2 | 7/2010 | Ueno | |
| 7,826,764 | B2 * | 11/2010 | Takahashi | 399/101 |
| 7,903,995 | B2 | 3/2011 | Nakamatsu et al. | |
| 8,532,531 | B2 * | 9/2013 | Shimura et al. | 399/129 |
| 2010/0003052 | A1 | 1/2010 | Nakamatsu et al. | |
| 2013/0051832 | A1 | 2/2013 | Aiba | |

FOREIGN PATENT DOCUMENTS

| | | | |
|---|---|---|---|
| JP | 10-10939 | A | 1/1998 |
| JP | 2000-19853 | A | 1/2000 |
| JP | 2006-293404 | A | 10/2006 |
| JP | 2007-121965 | A | 5/2007 |
| JP | 2008-122663 | A | 5/2008 |
| JP | 2009-20249 | A | 1/2009 |
| JP | 2010-14943 | A | 1/2010 |

* cited by examiner

*Primary Examiner* — William J Royer
(74) *Attorney, Agent, or Firm* — Fitzpatrick, Cella, Harper & Scinto

(57) ABSTRACT

An image forming apparatus includes: a rotatable image bearing member; a toner image forming portion; a transfer member; a cleaning blade, provided downstream of the transfer member and upstream of the toner image forming portion with respect to a rotational direction of the image bearing member; a discharging member, provided downstream of the cleaning blade and upstream of the toner image forming portion with respect to the rotational direction; and a thin plate-like member provided downstream of the discharging member and upstream of the toner image forming portion with respect to the rotational direction. An end of the thin plate-like member is contacted to a surface of the image bearing member toward an upstream side with respect to the rotational direction.

19 Claims, 10 Drawing Sheets

(a) $\beta > \delta$ (b) $\beta < \delta$

IMAGE FORMING APPARATUS WITH CLEANING BLADE

FIELD OF THE INVENTION AND RELATED ART

The present invention relates to an image forming apparatus for cleaning an image bearing member by bringing a cleaning blade into contact with the image bearing member, and specifically relates to a structure for efficiently removing a particulate matter (substance), which is transferred from a recording material onto the image bearing member and which then passes through a blade edge, from the image bearing member.

The image forming apparatus in which a toner image which is formed by an electrophotographic process and is borne on an image bearing member (photosensitive member or intermediary transfer member) is transferred onto a recording material and then the recording material on which the toner image is transferred is heated and pressed at a nip of a fixing device to fix an image on the recording material has been widely used.

On the image bearing member after the toner image is transferred, a transfer residual toner resulting from a developer or an external additive for the developer is deposited. As a cleaning device for removing the transfer residual toner or the external additive from the image bearing member, a blade cleaning device for rubbing the image bearing member with a cleaning blade has been widely used.

On the other hand, when the image bearing member is contacted to the recording material to transfer the toner image onto the recording material, paper powder is transferred from the recording material onto the image bearing member in some cases. The paper powder includes fiber fragments of cellulose and a particulate matter (filler) in general and the particulate matter is irregular in particle shape and is smaller in particle (size) than the toner, and therefore has a property such that it is liable to agglomerate at a blade edge of the cleaning blade (Japanese Laid-Open Patent Application (JP-A) Hei 10-10939).

In an image forming apparatus of JP-A Hei 10-10939, in order to eliminate the paper powder agglomerated at the blade edge of the cleaning blade, the image bearing member is reversely rotated periodically.

In a cleaning device of JP-A 2007-121965, a brush roller is provided in an upstream side of a cleaning blade with respect to a rotational direction of an intermediary transfer belt. The brush roller scrapes off the paper powder from the intermediary transfer belt to prevent the particulate matter in the paper powder from being deposited on the cleaning blade.

In a belt cleaning device in JP-A 2008-122663, cleaning blades are provided in two stages with respect to a rotational direction of an image bearing member and a toner passing through the first-stage cleaning blade is stopped and cleaned by the second-stage cleaning blade.

In a belt cleaning device of JP-A 2000-19853, an abrasive blade is contacted to an intermediary transfer belt to remove a deposited foreign matter.

In recent years, the type of recording materials used in the image forming apparatus is increased and the image forming apparatus is required to meet the recording material which generates the particulate matter such as the paper powder in a large amount. On the recording material which generates the particulate matter in the large amount, the generated particulate matter grows while being agglomerated and solidified at the blade edge to raise the blade edge, thus causing passing (slip)-through of the toner in some cases.

Therefore, as described in JP-A 2007-121965, disposition of the brush roller in the upstream side of the cleaning blade was studied. However, the particulate matter such as the paper powder is excessively small in particle size, so that a sufficient cleaning effect cannot be obtained by the brush roller. When the brush roller is mounted, the blade cleaning device is upsized and thus constitutes a hindrance to accommodation into the image forming apparatus.

Further, as described in JP-A 2008-122663, even when the cleaning blades are disposed in the two stages, the particulate matter such as the paper powder is excessively small in particle size, so that the sufficient cleaning effect cannot be obtained. The particulate matter having passed through the first-stage cleaning blade similarly passes through the second-stage cleaning blade.

Therefore, study such that the second-stage cleaning blade described in JP-A 2008-122663 is replaced with a resin blade having an elasticity coefficient higher than the ordinary cleaning blade to scrape off the particulate matter from the image bearing member was made.

However, as described later, the particulate matter having passed through the first-stage cleaning blade is charged and electrically deposited on the image bearing member and therefore the sufficient cleaning effect cannot be realized unless a contact pressure of the resin blade is considerably increased. Further, when the contact pressure of the recording material is increased, when hard particles pass through the recording material, there is a possibility that damage generates on the image bearing member.

SUMMARY OF THE INVENTION

A principal object of the present invention is to provide an image forming apparatus capable of effectively removing a particulate matter from an image bearing member even when a resin blade or the like is contacted to the image bearing member at a relatively low contact pressure.

According to an aspect of the present invention, there is provided an image forming apparatus comprising: a rotatable image bearing member for bearing a toner image; a toner image forming portion for forming the toner image on the image bearing member; a transfer member for electrostatically transferring the toner image from the image bearing member, on which the toner image is borne, onto a recording material at a transfer portion; a cleaning blade, provided downstream of the transfer portion and upstream of the toner image forming portion with respect to a rotational direction of the image bearing member, for removing a toner in contact with a surface of the image bearing member; a discharging member, provided downstream of the cleaning blade and upstream of the toner image forming portion with respect to the rotational direction of the image bearing member, for electrically discharging the image bearing member; and a thin plate-like member provided downstream of the discharging member and upstream of the toner image forming portion with respect to the rotational direction of the image bearing member, wherein an end of the thin plate-like member is contacted to a surface of the image bearing member toward an upstream side with respect to the rotational direction of the image bearing member.

In the image forming apparatus of the present invention, the discharging member electrically discharges particulate matter having passed through the cleaning blade to weaken deposition of the particulate matter on the surface of the image bearing member and therefore the particulate matter is easily separated from the image bearing member by the thin plate-like member.

Accordingly, even when the thin plate-like member is contacted to the image bearing member at a relatively low contact pressure, the particulate matter can be effectively removed from the image bearing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, embodiments of the present invention will be described in detail with reference to the drawings. The present invention can also be carried out in other embodiments in which a part or all of constitution of the following embodiments are replaced with alternative connections so long as a particulate matter electrically discharged in a downstream side of a cleaning blade is scraped off from an image bearing member by a resin blade or the like.

Therefore, the image bearing member is not limited to an intermediary transfer belt but may also be an intermediary transfer drum, a photosensitive drum or a photosensitive belt. Further, so long as the particulate matter is removed, the present invention can be carried out also with respect to a recording material conveying drum, a recording material conveying belt or a transfer belt.

The image forming apparatus can be carried out irrespective of types of full-color/monochromatic, one drum/tandem, recording material conveyance/intermediary transfer, the image bearing member, charging, exposure, transfer and fixing so long as a toner image is transferred onto a recording material.

In the following embodiments, a principal portion relating to formation and transfer of the toner image will be described but the present invention can be carried out in various fields of a printer, various printing machines, a copying machine, a facsimile machine, a multi-function machine, and the like by adding necessary equipment, device and casing structure.

<Image Forming Apparatus>

Figure 1:
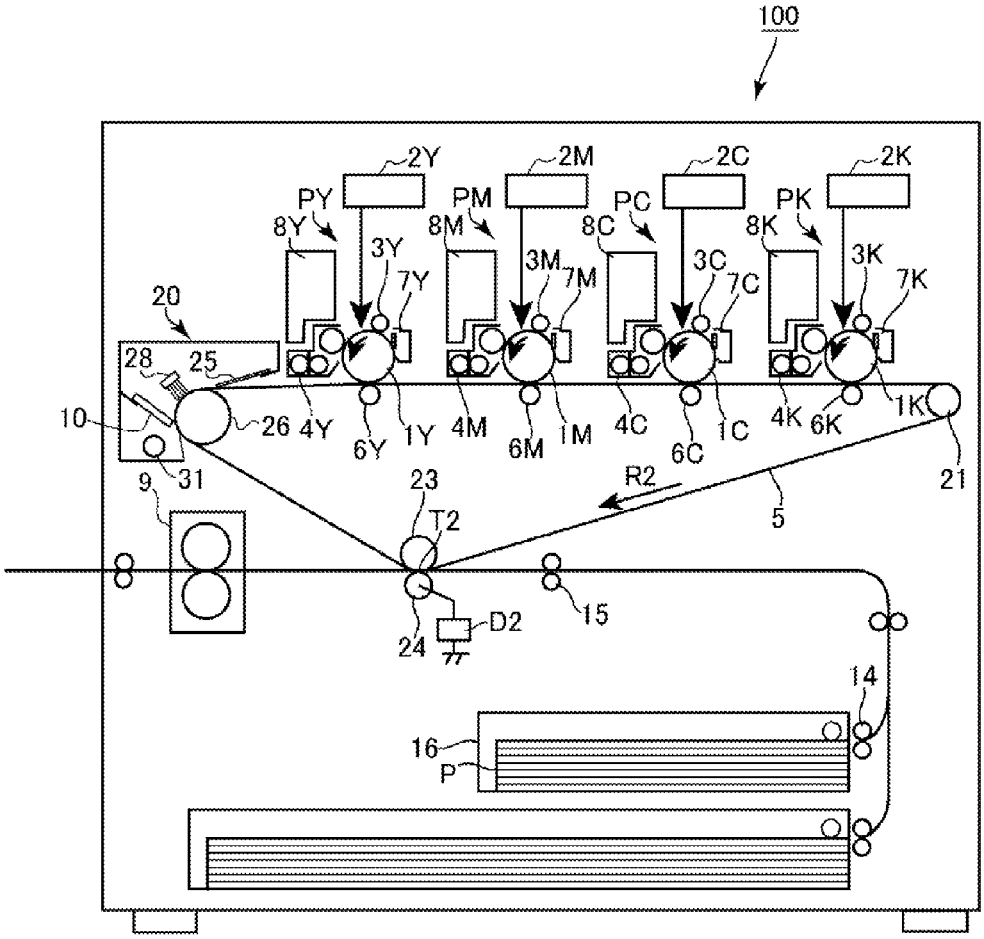
FIG. 1 is an illustration of a structure of an image forming apparatus.

FIG. 1 is an illustration of a structure of the image forming apparatus. As shown in FIG. 1, an image forming apparatus 100 is a full-color printer of the tandem type and of the intermediary transfer type in which image forming portions PY, PM, PC and PK are arranged along an intermediary transfer belt 5.

In the image forming apparatus PY, a yellow toner image is formed on a photosensitive drum 1Y, and is transferred onto the intermediary transfer belt 5. In the image forming portion PM, a magenta toner image is formed on a photosensitive drum 1M, and is transferred onto the intermediary transfer belt 5. In the image forming portions PC and PK, cyan and black toner images are formed on photosensitive drums 1C and 1K, respectively, and are transferred onto the intermediary transfer belt 5.

Four color toner images transferred onto the intermediary transfer belt 5 are conveyed to a secondary transfer portion T2, in which the toner images are secondary-transferred collectively onto a recording material P. A separation roller 14 separates sheets of the recording material P, one by one, drawn from a recording material cassette 16 and feeds the recording material P to a registration roller 15. The registration roller 15 sends the recording material P to the secondary transfer portion T2 by timing the recording material P to the toner images on the intermediary transfer belt 5. Onto the recording material P, the four color toner images are secondary-transferred in a process in which the recording material P is nipped and conveyed at the secondary transfer portion T2. Then, the recording material P on which the toner images are transferred is subjected to heat and pressure in a fixing device 9, so that an image is fixed on the surface of the recording material P and then the recording material P is discharged to the outside of the image forming apparatus 100.

The image forming portions PY, PM, PC and PK are substantially the same in structure except that colors of the toners used in developing devices 4Y, 4M, 4C and 4K are yellow, magenta, cyan and black, i.e., different from each other. The image forming portion PY will be described below, and as for the description of the other image forming portions PM, PC and PK, Y of the suffixes for showing a distinction among the image forming portions PY, PM, PC and PK shall be replaced with M, C and K, respectively.

In the image forming portion PY, around the photosensitive drum 1Y, a charging roller 3Y, an exposure device 2Y, the developing device 4Y, a primary transfer roller 6Y, and a drum cleaning device 7Y are provided. The photosensitive drum 1Y is prepared by forming a photosensitive layer on an outer peripheral surface of an aluminum-made cylinder, and is rotated in an arrow direction at a predetermined process speed. The charging roller 3Y charges the surface of the photosensitive drum 1Y to a uniform dark portion potential VD of a negative polarity by applying thereto an oscillating voltage in the form of a DC voltage biased with an AC voltage from an unshown power source.

The exposure device 2Y scans the surface of the photosensitive drum 1Y with a laser beam, obtained by subjecting scanning line image data expanded from a yellow separated color image to ON-OFF modulation, by using a rotating mirror, so that an electrostatic image for an image is written (formed) on the charged surface of the photosensitive drum 1Y.

The developing device 4Y stirs a developer in which a carrier is mixed with a toner to charge the toner to a negative polarity and the carrier to a positive polarity. The charged developer is carried on a developing sleeve rotating in a counter direction to the photosensitive drum 1Y at a periphery of a fixed magnet to slide on the photosensitive drum 1Y. An unshown power source applies to the developing sleeve an oscillating voltage in the form of a DC voltage of a negative polarity biased with an AC voltage. As a result, the toner is moved from the developing sleeve onto the electrostatic image on the photosensitive drum 1Y having the positive polarity relative to the developing sleeve.

A toner supplying device 8Y supplies, every one sheet for image formation, the toner corresponding to that consumed by the image formation to the developing device 4Y, thus keeping a toner weight ratio (toner content) of the developer in the developing device 4Y at a constant level.

The primary transfer roller 6Y is disposed inside the intermediary transfer belt 5 at a position corresponding to that of the photosensitive drum 1Y. The primary transfer roller 6Y urges the intermediary transfer belt 5 to form a primary transfer portion between the photosensitive drum 1Y and the intermediary transfer belt 5. An unshown power source applies a DC voltage of a positive polarity to the primary transfer roller 6Y to primary-transfer the toner image from the negatively charged photosensitive drum 1Y onto the intermediary transfer belt 5 passing through the primary transfer portion.

The primary transfer roller 6Y is formed by coating an outer peripheral surface of a cylindrical metal member formed of electroconductive metal in a diameter of 8 mm with a 1.0 mm-thick layer of an electroconductive foam rubber material of $5.0\times10^6$ (Ω/cm) in volume resistivity. The weight of the primary transfer roller 6Y is 300 g.

As an urging mechanism for urging an inner surface of the intermediary transfer belt 5 toward the photosensitive drum 1Y, an unshown spring member presses the primary transfer roller 6Y at end portions of the primary transfer roller 6Y upward in the vertical direction at a total pressure of 15 N (1.5 kgf). As a result, the primary transfer portion for the toner image is formed between the photosensitive drum 1Y and the intermediary transfer belt 5. By electrical action of the voltage applied to the primary transfer roller 6Y and an urging force, the toner image passing through the primary transfer portion is transferred onto the intermediary transfer belt 5. The position of the primary transfer roller 6Y is shifted from the center of the photosensitive drum 1Y by 2.5 mm toward a downstream side of a conveyance direction of the intermediary transfer belt 5. During normal image formation, when the toner image on the photosensitive drum 1Y is transferred onto the intermediary transfer belt 5, a transfer current of 30 μA passes through the primary transfer roller 6Y.

The drum cleaning device 7Y rubs the photosensitive drum 1Y with a cleaning blade to collect the transfer residual toner which passes through the primary transfer portion and then is deposited on the surface of the photosensitive drum 1Y. The drum cleaning device 7Y is constituted by the cleaning blade for scraping off the transfer residual toner on the photosensitive drum 1Y and a receptor sheet for collecting the scraped toner.

The image forming apparatus of the intermediary transfer type is capable of setting the positions of the sheet feeding device and the fixing device relatively freely. By disposing the sheet feeding device and the fixing device below the photosensitive drum, it is possible to downsize the image forming apparatus with respect to a recording material conveyance direction. The image forming apparatus of the intermediary transfer type can dispose the fixing device with sufficient latitude such that the recording material can be bent.

<Photosensitive Drum>

The photosensitive drum 1Y is an organic photosensitive member which is prepared by applying an OPC (organic photo(semi)conductor) on a drum support made of aluminum to provide a photosensitive layer having a five-layer structure and which has a negative charge polarity.

The first layer is an undercoat layer consisting of a 20 μm-thick electroconductive layer and is provided for smoothing a defect or the like of the aluminum support. The second layer is a positive electric charge injection preventing layer consisting of a 1 μm-thick medium resistance layer adjusted in resistance to $10\times10^6$ Ω·cm by Alamine resin and methoxymethylated nylon, and prevents the positive electric charge injected from the drum support from canceling the negative electric charge on the photosensitive member surface.

The third layer is an about 0.3 μm-thick charge generating layer in which a diazo pigment is dispersed in a resin material and generates a positive and negative charge pair by being subjected to light exposure. The fourth layer is a charge transporting layer of P-type semiconductor in which hydrazone is dispersed in polycarbonate resin. The negative electric charge on the photosensitive member surface cannot move in the charge transporting layer, so that the charge transporting layer transports only the positive electric charge generated in the charge generating layer to the photosensitive member surface.

The fifth layer is an electric charge injection layer formed by applying a material in which ultrafine particles of $SnO_2$ are dispersed in an insulating resin binder. The electric charge injection layer is specifically formed by applying a material in which the insulating resin is doped with antimony as a light-transmissive insulating filler to realize a low resistance (electroconductivity) and then in this resin, 70 wt. % of $SnO_2$ particles of 0.03 μm in particle size are dispersed. The thus prepared coating liquid is coated in a thickness of about 3 μm by an appropriate coating method such as dipping, spray coating, roll coating or beam coating, so that the electric charge injection layer is formed.

Incidentally, as the photosensitive drum 1Y, in addition to the organic photosensitive member, an amorphous silicon photosensitive member, a metal oxide-based photosensitive member and the like can be used. The resistance value of the surface layer of the photosensitive member may preferably be $10^9$-$10^{14}$ Ωcm. This is because electric charge injection charging which does not rely on electric discharge can be realized and therefore there is an effect in preventing a generation of ozone and in reducing electric power consumption, and thus it is possible to improve also a charging property.

<Developer>

The developing device 4Y develops the electrostatic image on the photosensitive drum 1Y with the two-component developer in which the carrier (magnetic) and the toner (non-magnetic) are mixed. The developer in which the carrier and the toner are mixed in a weight ratio of 91:9 (toner content: 9%) was used. A total weight of an initial developer accommodated in the developing device 4Y was 350 g.

As the carrier, one obtained by coating ferrite particles with silicone resin is used and is 24 ($Am^2$/kg) in saturation magnetization under applied magnetic field of 240 (kA/m). Further, the carrier is $1\times10^7$–$1\times10^8$ (Ω·cm) in resistivity at field intensity of 3000 (V/cm) and is 50 μm in weight-average particle size.

The toner is constituted by at least a binder, a colorant and a charge control agent. In this case, as the binder resin, styrene-acrylic resin is used. However, it is also possible to use resins of styrene type, polyester type, polyethylene and the like. As the colorant, those of various pigments, various dyes and the like may be used in one species alone or in combination of plural species. As the charge control agent, an electric charge control agent for reinforcement as desired may also be contained. As the electric charge control agent for reinforcement, a nigrosine-based dye, a triphenylmethane-based dye and the like can be used.

The toner contains a wax. The wax is contained for improving a parting property from a fixing member and a fixing property during fixing. As the wax, paraffin wax, carnauba wax, polyorefin and the like can be used and are used by being kneaded and dispersed in the binder resin. In this case, the resin material in which the binder, the colorant, the charge control agent and the wax were kneaded and dispersed was pulverized by a mechanical pulverizer and then was used.

The toner contains an external additive. Examples of the external additive may include one obtained by subjecting amorphous silica to hydrophobization and fine particles of inorganic oxide such as titanium oxide or titanium compound. These fine particles are added into the toner to adjust powder flowability and charge amount of the toner. The particle size of the particles of the external additive may preferably be 1 nm or more and 100 nm or less. In this case, the fine particles of titanium oxide of 50 nm in average particle size were added in weight ratio of 0.5 wt. %, and the fine particles of two types of amorphous silica of 2 nm and 100 nm in average particle size were added in weight ratio of 0.5 wt. % and 1.0 wt. %, respectively.

When the particle size of the above-constituted toner was measured by a power particle size image analyzer ("FPIA-3000, mfd. by Sysmex Corp.), the weight-average particle size was 5.7 μm.

<Intermediary Transfer Belt>

The intermediary transfer belt 5 is extended and supported by a driving roller 21, a tension roller 26 and an opposite roller 23, and is rotated in an arrow R2 direction by rotation of the driving roller 21 in the clockwise direction in FIG. 1. The driving roller 21 is grounded and is adjusted to have a resistance value of $1\times10^3\Omega$-$1\times10^5\Omega$ by disposing a coating layer of an electroconductive rubber material on a peripheral surface of a metal shaft member. A peripheral speed of the photosensitive drum 1Y and a peripheral speed of the intermediary transfer belt 5 are equal to a process speed and are 300 mm/sec.

A secondary transfer roller 24 is controlled to the outer peripheral surface of the intermediary transfer belt 5 supported by the opposite roller 23 connected to the ground potential, thus forming the secondary transfer portion T2. A transfer power source D2 applies a positive-polarity DC voltage to the secondary transfer roller 24, so that the toner image on the intermediary transfer belt 5 passing through the secondary transfer portion T2 is transferred onto the recording material P.

The intermediary transfer belt 5 was prepared by dispersing carbon black in a base material of 85 μm-thick polyimide resin film to be resistance-adjusted to $1\times10^{12}$ (&OY/sq) in surface resistivity and $1\times10^9$ (Ω·cm) in volume resistivity.

<Belt Cleaning Device>

A belt cleaning device 20 rubs the intermediary transfer belt 5 with a cleaning blade 10 to collect the transfer residual toner passing through the secondary transfer portion T2 and being deposited on the intermediary transfer belt 5. The toner scraped off from the intermediary transfer belt 5 by the cleaning blade 10 is accumulated in an unshown collected toner container provided in a front side of the main assembly of the image forming apparatus 100 by a feeding screw 31.

The cleaning blade 10 is molded in a thickness of 1 mm-2 mm by using an urethane rubber material. The cleaning blade 10 is contacted to the intermediary transfer belt 5 at its end in a counter direction to the rotational direction of the intermediary transfer belt 5 and is pressed by a spring toward the intermediary transfer belt 5 so that a contact angle of its end is 20 degrees.

As a material for the cleaning blade 10, any material can be used so long as the material is a rubber material having proper elasticity and hardness. Examples of an ordinary material for the cleaning blade 10 may include polyurethane, styrene-butadiene copolymer, chloroprene, butadiene rubber, ethylene-propyrene-dien rubber, and chlorosulfonated polyethylene rubber. It is also possible to use elastomers such as fluorine-containing rubber, silicone rubber, acrylic rubber, nitrile rubber, and chloroprene rubber. Particularly, polyurethane which has elasticity to the extent that the intermediary transfer belt 5 is not damaged by rubbing and which shows high wear resistance is preferred. In view of small permanent deformation, a two-component thermosetting polyurethane material is also used in some cases. As a curing agent, it is possible to use an ordinary urethane curing agent such as 1,4-butanediol, 1,6-hexamediol, hydroquinonediethyloldiol, bisphenol A, trimethylolpropane and trimethylolethane. In this embodiment, an urethane rubber blade of 8 MPa in Young's modulus was used.

A receptor sheet 32 is formed by cutting a 20-50 μm-thick sheet material of polyethylene terephthalate resin. An end of the receptor sheet 32 is contacted to the intermediary transfer belt 5 so that its extension direction is the same as the rotational direction of the intermediary transfer belt 5. The receptor sheet 32 collects the toner in the belt cleaning device 20 so that the toner which is once accumulated at the end of the cleaning blade 10 to be dropped is prevented from falling in drops.

Recently, the image forming apparatus is required to meet large-sized paper which is called A3+ size. With readiness to meet the large-sized paper, a width of the intermediary transfer belt is extended and also a length of the cleaning blade is increased. When the cleaning blade becomes long, an amount of blade distortion over a full length of the cleaning blade becomes large, so that passing (slip)-through of the toner is liable to occur. For this reason, there is a need to frequently supply a toner band to the cleaning blade to keep a state in which a small amount of the toner is held at the blade edge.

However, supply of the toner band by temporarily interrupting continuous image formation to form the toner band on the photosensitive drum and then by transferring the toner band from the photosensitive drum onto the intermediary transfer belt generates a down time to impair productivity of the image forming apparatus. For this reason, even when the cleaning blade of the belt cleaning device becomes long, it is required that a frequency of the supply of the toner band is not increased.

<Recording Material and Paper Powder>

Figure 2:
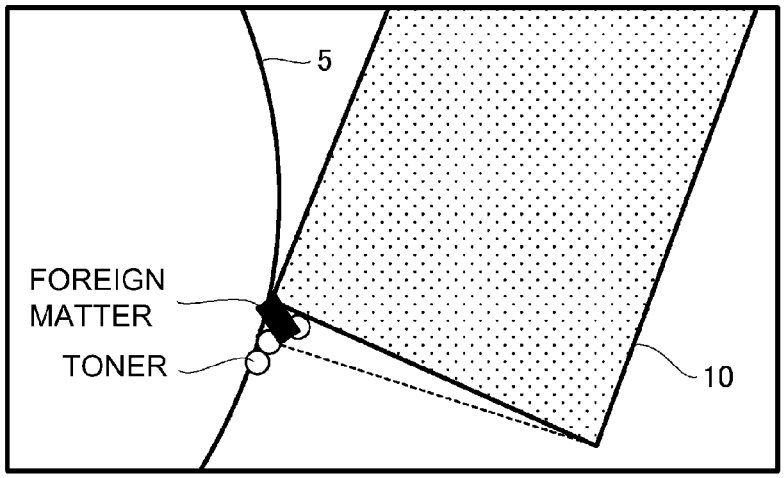
FIG. 2 is an illustration of a foreign matter fixed on a blade edge.
Figure 3:
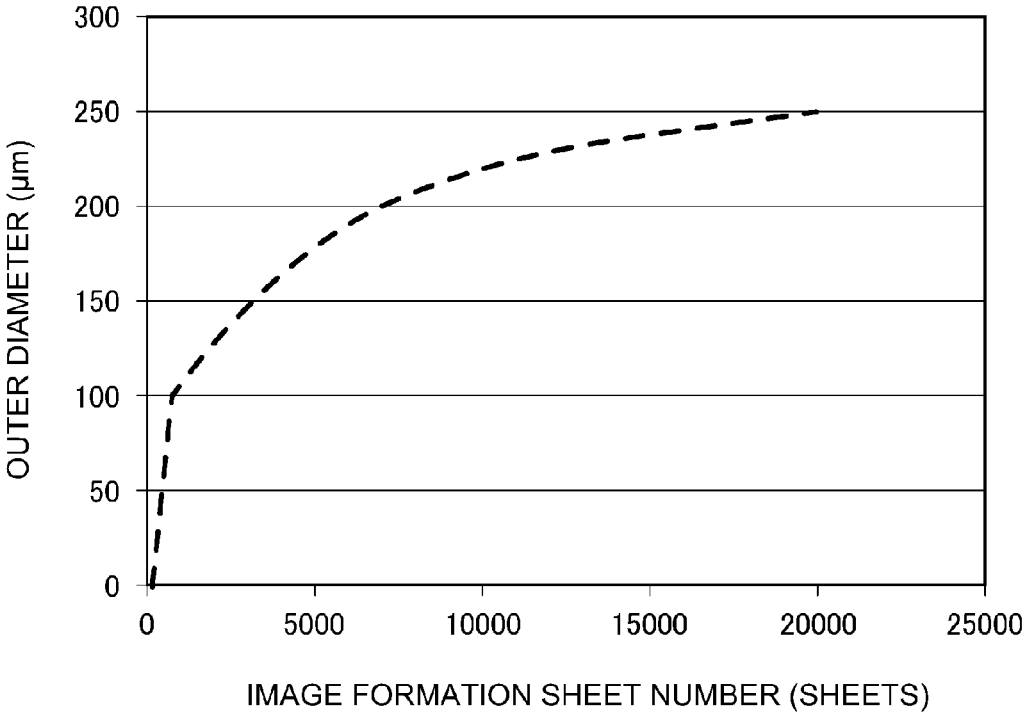
FIG. 3 is an illustration of a growing speed of the fixed foreign matter.

FIG. 2 is an illustration of a foreign matter fixed on the blade edge. FIG. 3 is an illustration of growing speed of the fixed foreign matter. Recently, the image forming apparatus is required to meet the recording materials with paper qualities in a wide range. Depending on the type of the recording material, in some cases, the recording material contains a particulate matter (filler of paper, talc) in a large amount. In the case where the process speed is low, similarly as readiness to meet the external additive of the developer, it was considered that if the toner in a small amount is stagnated at the end of the cleaning blade, the particulate matter can be collected together with the transfer residual toner in an intermingled state with the toner.

However, recently, by the increase in process speed, even with respect to the same recording material, the amount per unit time of the particulate matter flowing into the cleaning blade was considerably increased. In addition, in the case where the recording material of the type in which a generation amount of the particulate matter is large, the amount per unit time of the particulate matter flowing into the cleaning blade is excessively large, so that there was the case where it is difficult to remove the particulate matter in the intermingled state with the toner.

As shown in FIG. 2, when the continuous image formation is effected at a high process speed by using the recording material with a large generation amount of the paper powder enters the cleaning blade of the belt cleaning device. When the particulate matter entered the cleaning blade is fixed on the blade edge of the cleaning blade, the distortion amount of the cleaning blade becomes large and thus the passing-through of the toner is liable to occur.

When the belt cleaning device including only the cleaning blade is mounted in the image forming apparatus 100 and then the continuous image formation of an image locally at a part of the recording material is executed by using the recording material with the large generation amount of the paper powder, the passing-through of the toner was generated in continuous sheet passing of 1000 sheets. An environmental condition of an experiment is a normal temperature and normal humidity environment consisting of room temperature of 23° C. and (relative) humidity of 50%.

Then, when the cleaning blade is demounted from the belt cleaning device on which the passing-through of the toner is generated and is subjected to microscopic observation of the blade edge, fixing of the foreign matter was observed at a portion where the toner passes through the blade edge. When the cleaning blade is mounted again in the image forming apparatus 100 as it is and then the continuous sheet passing is continued from 1000 sheets to 5000 sheets and then to 10000 sheets, as shown in FIG. 3, the size of the foreign matter observed through the microscope grew to 200 μm or more and thus a degree of the passing-through of the toner became worse.

When the foreign matter is collected from the blade edge and is subjected to identification of a substance by fluorescent X-ray measurement, the foreign matter was constituted by heavy calcium carbonate or the like which was a filler of the paper as the recording material. Further, by the fluorescent X-ray measurement, it was also confirmed that the filler of the recording material principally contained heavy calcium carbonate. According to the microscopic observation, the filler was an aggregate of particles of 3 μm or less in particle size.

Accordingly, the foreign matter is one accumulated on the cleaning blade 10 after the filler liberated from the paper as the recording material passing through the secondary transfer portion T2 and then transferred onto the intermediary transfer belt 5 is conveyed to the cleaning blade 10. It would be considered that the observed foreign matter is one growing from a small foreign matter, as a starting point, checked by and stagnated at the blade edge to a large foreign matter by gradually accumulating a subsequent filler.

It would be considered that a mechanism of a phenomenon that the filler is accumulated at the blade edge of the cleaning blade is as follows. First, the filler of several microns or less in size passes through the cleaning blade 10 and the intermediary transfer belt 5 continues its rotation in a state in which the filler is deposited on the intermediary transfer belt 5 as it is (the filler is moved together with the intermediary transfer belt 5). When the filler deposited on the intermediary transfer belt 5 is gradually increased, a first cluster of the foreign matter as the starting point of fixing is formed at the blade edge of the cleaning blade 10. The filler moved together with the intermediary transfer belt 5 successively collides with the cluster to be accumulated.

When the filler starts the accumulation at the blade edge, the filler is not easily removed by the toner residual toner or the like. The filler fixed at the blade edge of the cleaning blade is not easily removed in an ordinary rotation state of the intermediary transfer belt 5 in a normal rotational direction.

Accordingly, if the filler which passes through the cleaning blade 10 and which is then moved together with the intermediary transfer belt 5 can be removed efficiently, the growth of the filler at the blade edge of the cleaning blade 10 is suppressed and thus the passing-through of the toner is prevented from occurring. However, the filler has the particle size which is about 1/20 to about 1/3 of that of the toner and therefore the filler cannot be sufficiently scraped off by the cleaning blade 10 on the assumption that the foreign matter is the toner particles.

Comparative Embodiment 1

Figure 4:
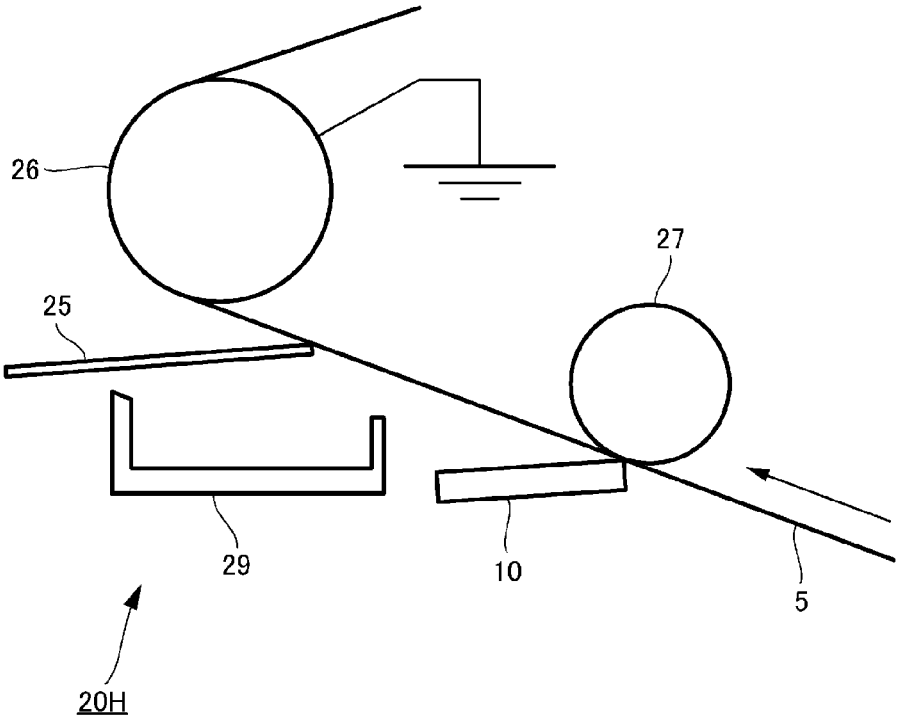
FIG. 4 is an illustration of a structure of a belt cleaning device in Comparative Embodiment 1.
Figure 5:
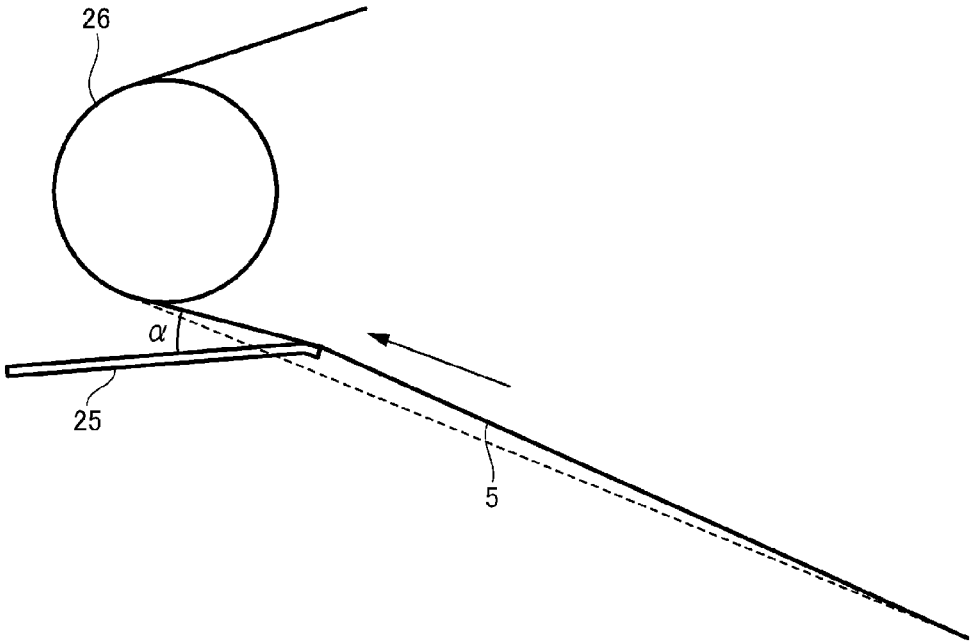
FIG. 5 is an illustration of a contact angle of a resin blade with respect to an intermediary transfer belt.
Figure 6:
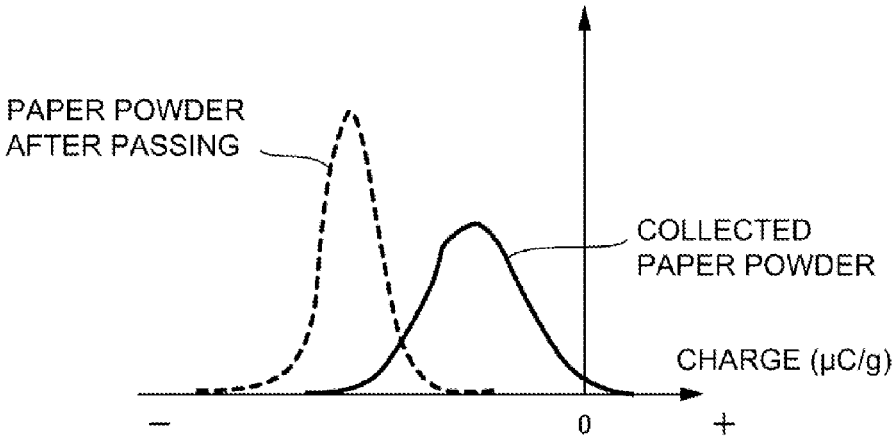
FIG. 6 is an illustration of charging of a particulate matter by a cleaning blade.

FIG. 4 is an illustration of a structure of a belt cleaning device in Comparative Embodiment 1. FIG. 5 is an illustration of a contact angle of a resin blade for the intermediary transfer belt. FIG. 6 is an illustration of charging of the filler at the cleaning blade.

As shown in FIG. 4, in a belt cleaning device 20H in Comparative Embodiment 1, a resin blade 25 assumed that it is used for scraping off the filler is provided downstream of the cleaning blade 10 to remove the filler moved together with the intermediary transfer belt 5. As a result, the growth of the filler at the blade edge of the cleaning blade 10 is stopped to stabilize a cleaning performance of the cleaning blade 10, so that the filler is prevented from causing the passing-through of the toner by the fixing and growth thereof at the blade edge.

As shown in FIG. 5, the resin blade 25 is one obtained by cutting a 200 μm-thick sheet material of PET resin (trade name: "Lumiler") into a size of 20 mm in width and 340 mm in length. The resin blade 25 was able to obtain a similar effect even when its material was replaced with a resin sheet material (trade name: Dialamy, Pellicule) other than the PET resin.

Figure 15:
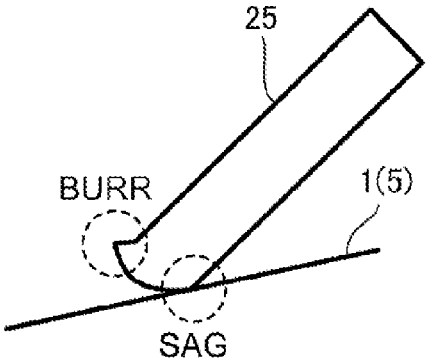

As shown in FIG. 15, the resin blade 25 is required that a position where it contacts the intermediary transfer belt 5 is in a sag size. When the resin blade 25 is contacted to the intermediary transfer belt 5 in a burr side, a rubbing damage (scar) is generated. When the damage of 2 μm or more in depth is generated in the intermediary transfer belt 5, there is a possibility that the passing-through of the toner is generated at the blade edge of the cleaning blade 10.

The resin blade 25 can obtain a similar scraping-off effect even when its material is replaced with a metal plate material such as a stainless steel plate.

However, in order that the rubbing damage is prevented from being generated in the intermediary transfer belt 5, the resin blade 25 may preferably be formed with a soft material to the possible extent within a range in which a scraping-off performance can be maintained. A suitable material for the resin blade 25 is about 1.5-7.0 GPa in Young's modulus. In this embodiment, the resin blade of 4.5 GPa in Young's modulus was used. This is because when the rubbing damage of 2 μm or more in depth is generated in the intermediary transfer belt 5, there is a possibility of the occurrence of the passing-through of the toner at the blade edge of the cleaning blade 10.

Further, this is also because non-uniformity of a transfer property of the toner image carried on the intermediary transfer belt 5 is generated between an occurrence position of the rubbing damage and another position and therefore there is a possibility that a stripe image along the rubbing damage is formed on an output image. In the case where the metal plate is used, there is a need to make a penetration (entering) amount with respect to the intermediary transfer belt smaller than that of the resin material so as not to generate the rubbing damage and to subject a contact surface with the intermediary transfer belt (member) to deburring.

The resin blade 25 is contacted to the intermediary transfer belt 5 at its end in a counter direction to the rotational direction of the intermediary transfer belt 5 in a state in which it is inclined 20 degrees from the intermediary transfer belt 5, and is fixed to a frame of the belt cleaning device 20H in its base side. The resin blade 25 may preferably be set at a contact angle α of 10-40 degrees. When the contact angle is excessively large, a contact state between the resin blade 25 and the intermediary transfer belt 5 becomes unstable. When the contact angle is excessively small, the contact pressure cannot be sufficiently ensured and cannot completely collect the filler.

The penetration amount of the end of the resin blade 25 with respect to the intermediary transfer belt 5 may desirably be 4 mm or less. The penetration amount of the end of the resin blade 25 with respect to the intermediary transfer belt 5 was set at 1 mm. When the penetration amount is set at 4 mm or more, the edge of the resin blade 25 is not contacted to intermediary transfer belt 5 but the resin blade 25 is surface-contacted to the intermediary transfer belt 5. When the resin blade 25 is surface-contacted to the intermediary transfer belt 5, the edge of the resin blade 25 does not collide with the filler so that a scraping-off collection force is undesirably lowered.

The belt cleaning device 20H in Comparative Embodiment 1 was mounted in the image forming apparatus 100 and was subjected to observation of the cleaning blade 10 and evaluation of the passing-through of the toner in each of stages of the continuous image formation by using the above-described recording material with the large generation amount of the filler. The environment condition of the experiment was the same as that in the above-described experiment, i.e., the normal temperature and normal humidity environment including room temperature of 23° C. and the humidity of 50%.

As a result, at the time of the sheet passing of 1000 sheets, the accumulation of the filler on the resin blade 25 was confirmed. It was presumed that the filler having a small particle size and an irregular shape compared with the toner was checked by the resin blade 25 after passing through the cleaning blade 10 and then was removed from the intermediary transfer belt 5. Thereafter, when the continuous image formation was continued, even after the sheet passing of 200,000 sheets, the filler, assuming that it passed through the cleaning blade 10, was continuously collected by the resin blade 25. A stable cleaning performance was maintained without causing the filler to accumulate at the blade edge of the cleaning blade 10, so that the passing-through of the toner was not generated.

Further, a similar experiment was conducted also in a high temperature and high humidity environment in which the temperature and the humidity were higher than the room temperature of 23° C. and the humidity of 50%. By disposing the belt cleaning device 20H in Comparative Embodiment 1, the filler was collected by the resin blade 25 and was not accumulated on the cleaning blade 10, so that the passing-through of the toner was not generated.

However, in a low humidity environment including room temperature of 23° C. and the humidity of 5%, even when the belt cleaning device 20H in Comparative Embodiment 1 was disposed, at the time of the sheet passing of 1,000 sheets, the filler fixing was observed at the blade edge of the cleaning blade 10. Thereafter, at the time of the sheet passing of 10,000 sheets, the passing-through of the toner was generated and thus the cleaning performance could not be maintained.

Therefore, during the experiment under the low humidity environment including room temperature of 23° C. and the humidity of 5%, the filler was collected from the surface of the intermediary transfer belt 5 in each of the upstream side and downstream side of the cleaning blade 10 and then a charge amount Q/M thereof was measured. Similarly as in the case where the toner charge amount Q/M of the transfer residual toner, the filler was sampled from the intermediary transfer belt 5 by suction and the charge amount of the filler was measured by using a particle analyzer ("E-Spart", mfd. by Hosokawa Micron Corp.), so that a graph of a charge amount distribution was outputted.

As shown in FIG. 6, the charge amount Q/M of the filler was −5 μC/g in average before the passing of the filler through the cleaning blade 10, but on the other hand was considerably increased to −25 μC/g in average after the passing of the filler through the cleaning blade 10. As a result, it was considered that the filler was increased in charge amount when it passed through the cleaning blade 10 and thus an electric deposition force of the filler on the intermediary transfer belt 5 was increased and therefore the filler was not readily removed by the resin blade 25.

A measurement result of the charge amount Q/M of the filler in each of the temperature and humidity environments is shown in Table 1.

TABLE 1

| | Temp. | Humidity | Ave. Charge amount (μC/g) | |
|---|---|---|---|---|
| No. | (° C.) | (%) | Before | After |
| 1 | 23 | 80 | −2 | −5 |
| 2 | 23 | 60 | −3 | −8 |
| 3 | 23 | 50 | −3 | −10 |
| 4 | 23 | 20 | −10 | −25 |
| 5 | 23 | 5 | −15 | −28 |

As shown in Table 1, the charge amount of the filler becomes larger with a low humidity environment. It was considered that in the low humidity environment, an electrostatic attraction force acting between the intermediary transfer belt 5 and the filler became large and it became difficult to collect the filler by the resin blade 25 and therefore there was a need to effect electric discharging of the filler before the collection by the resin blade 25.

Embodiment 1

Figure 7:
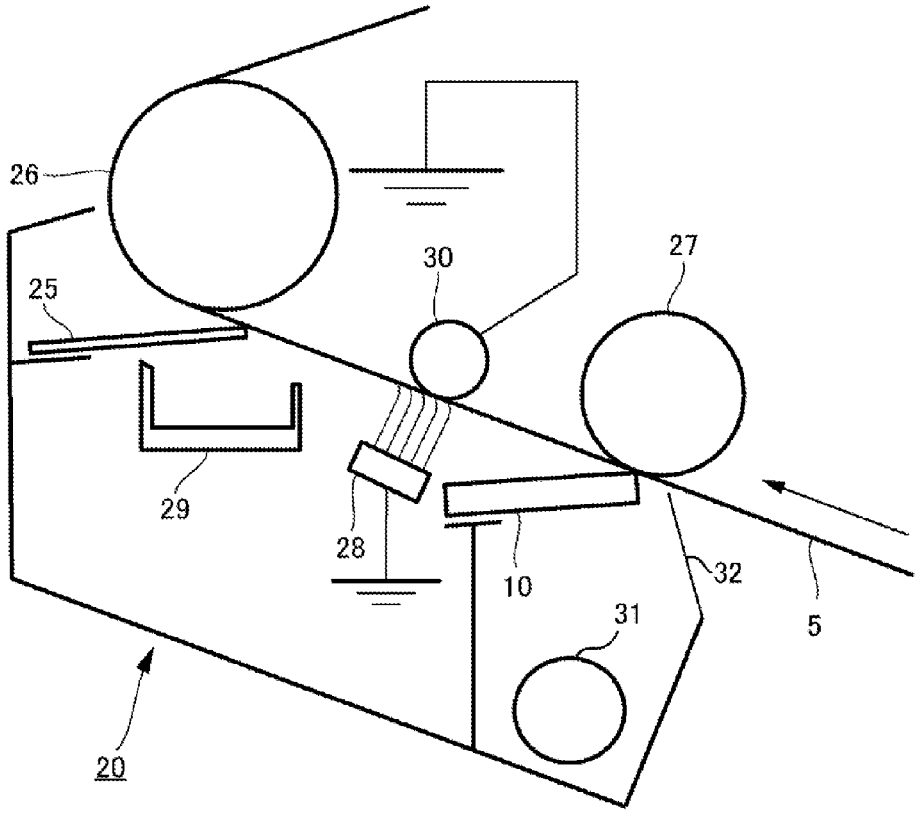
FIG. 7 is an illustration of a structure of a belt cleaning device in Embodiment 1.
Figure 8:
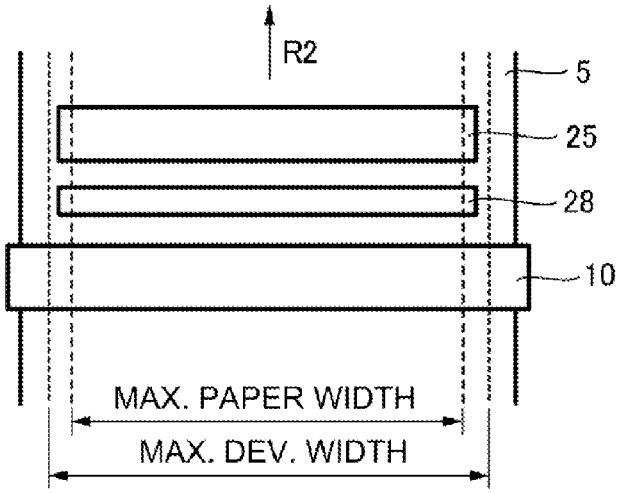
FIG. 8 is an illustration of arrangement of a discharging brush.

FIG. 7 is an illustration of a structure of a belt cleaning device in Embodiment 1. FIG. 8 is an illustration of arrangement of a discharging brush.

As shown in FIG. 1, the intermediary transfer belt 5 which is an example of the image bearing member is a belt member formed in an endless belt shape, and carries the toner image and then transfers the toner image onto the recording material. The cleaning blade 10 is contacted to the surface of the intermediary transfer belt 5 after the toner image is transferred, thus removing the transfer residual toner.

A discharging brush 28 which is an example of a discharging means electrically discharges (charge-removes) the filler which passes through the cleaning blade 10 and then is deposited on the surface of the intermediary transfer belt 5. An opposite roller 30 which is an example of an electroconductive supporting roller supports an inner surface of the intermediary transfer belt between the cleaning blade 10 and the resin blade 25, and is connected to the ground potential. The discharging brush 28 which is an example of an electroconductive brush member rubs the intermediary transfer belt in a side opposite from the opposite roller 30 and is connected to the ground potential.

The resin blade 25 which is an example of a thin plate-like member is formed in a thickness smaller than that of the cleaning blade 10 by using a material having a higher elastic coefficient than that of the cleaning blade 10. The end of the resin blade 25 is contacted to the surface of the intermediary transfer belt 5, after the intermediary transfer belt surface passes through the discharging brush 28, toward the upstream side of the rotational direction at a downward surface of the intermediary transfer intermediary transfer belt 5. The resin blade 25 is contacted to the belt at a position where the inner surface of the intermediary transfer belt 5 is not supported. The resin blade 25 is constituted by a PET resin sheet of 50 μm or more and 100 μm or less in thickness.

As shown in FIG. 7, in the belt cleaning device 20 in Embodiment 1, the discharging brush 28 was disposed so as to rub the intermediary transfer belt 5 at a position corresponding to a position between the cleaning blade 10 and the resin blade 25 of the belt cleaning device 20H in Comparative Embodiment 1. The discharging brush 28 was caused to rub the outer surface of the intermediary transfer belt 5 supported by the opposite roller 30 of aluminum connected to the ground potential. The electric resistance of the opposite roller 30 may desirably be $1.0\times10^{6}\Omega$ or less. The discharging brush 28 is electroconductive nylon in material, 6 mm in fiber length, 5 mm in width, 350 mm in length, 100 kF in planted fiber density, 6D in fiber thickness, and 2 mm in penetration amount with respect to the surface of the intermediary transfer belt 5. The filler scraped off by the resin blade 25 falls in the direction of gravitation to be collected by a collecting container 29.

As shown in FIG. 8, the resin blade 25 collects the filler, passing through the cleaning blade 10, in a range which is wider than a width of the maximum-sized recording material by 5 mm at each of left and right end portions outside the left and right edges of the recording material. The discharging brush 28 electrically discharges the filler, passing through the cleaning blade 10, in a range which is wider than the width of the maximum-sized recording material by 5 mm at each of left and right end portions outside the left and right edges of the recording material. The cleaning blade 10 rubs the intermediary transfer belt 5 in a range which is wider than a maximum development width by 2 mm at each of left and right end portions outside the left and right edge (end) of the maximum development width in order to remove the toner band which is formed by development by the developing device and then is supplied to the blade edge.

The belt cleaning device 20 in Embodiment 1 was mounted in the image forming apparatus 100 and was subjected to observation of the cleaning blade 10 and evaluation of the passing-through of the toner in each of stages of the continuous image formation by using the above-described recording material with the large generation amount of the filler. The continuous image formation of 5,000 sheets was effected under an environment, of room temperature of 20° C. and the humidity of 5%, which is severe than those in the experiment in Comparative Embodiment 1.

As a result, it was confirmed that the filler principally containing heavy calcium carbonate was stably collected continuously and was not fixed and accumulated at the blade edge of the cleaning blade 10. Further, the continuous image formation was effected until 200,000 sheets but the filler was not accumulated at the blade edge of the cleaning blade 10 and the passing-through of the toner was not generated until final image formation, so that a good cleaning performance was maintained.

Further, when the filler was sampled in front of and behind the discharging brush 28 and then its charge amount Q/M was measured to check the discharging effect, the average charge amount before passing the discharging brush 28 was −25 μC/g, whereas the average charge amount after passing the discharging brush 28 was about −5 μmC/g. That is, the discharging effect by the discharging brush 28 was confirmed. It was confirmed that the filler increased in charge when it passed through the cleaning blade 10 and was electrically discharged by the discharging brush 28 to be lowered in electrostatic attraction force with respect to the intermediary transfer belt 5. For this reason, it would be considered that the scraping-off of the filler by the resin blade 25 becomes easy and thus the filler moved together with the intermediary transfer belt 5 is decreased.

According to the belt cleaning device 20 in Embodiment 1, a mechanism for appropriately discharging and collecting the filler which passes through the cleaning blade 10 and which is then moved together with the intermediary transfer belt 5 is provided, so that a stable belt cleaning performance can be ensured for a long term.

The filler is generated in a large amount from a cut surface of the recording material and therefore is generated in the large amount at positions of widthwise edges perpendicular to the recording material conveyance direction, so that the filler is liable to be deposited at positions corresponding to edges of the blade edge of the cleaning blade 10 with respect to the widthwise direction of the recording material. The discharging brush 28 disperses such concentrated filler on the intermediary transfer belt 5, thus facilitating the discharging of individual particles. The discharging brush 28 alleviates the filler concentration at two positions corresponding to the edges of the blade edge of the cleaning blade 10 with respect to the widthwise direction of the recording material, thus causing the filler not to be readily accumulated at the blade edge.

Embodiment 2

Figure 9:
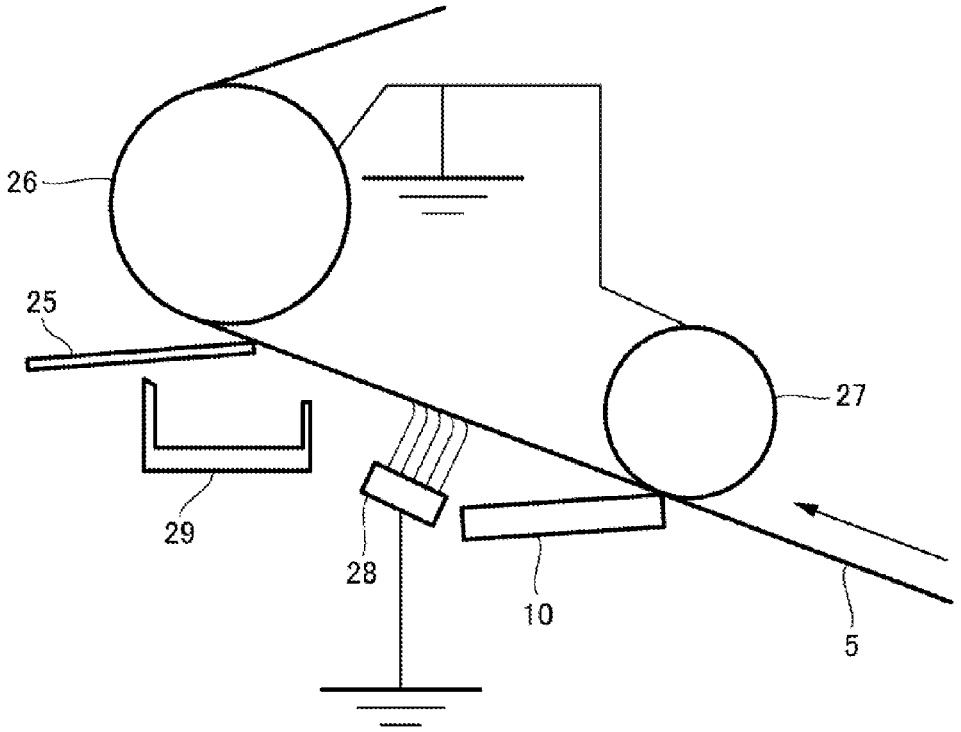
FIG. 9 is an illustration of another example of a discharging circuit structure of the discharging brush.

FIG. 9 is an illustration of another example of a discharging circuit structure of the discharging brush 28. In Embodiment 1, in order to electrically discharge the filler moved together with the intermediary transfer belt 5, the fixed discharging brush 28 was used. However, the constitution and the operation condition of the discharging brush 28 are not limited to those in Embodiment 1. As the discharging member 28, it is possible to use an electroconductive fur brush, which is a rotatable member, other than the fixed electroconductive brush. As the discharging member 28, provision of a corona charger or a discharging needle brings about a similar effect.

As shown in FIG. 9, in the case where there is no opposite roller 30 shown in FIG. 7, a tension roller 26 in an upstream side of a contact position of the discharging brush 28 and a tension roller 27 in a downstream side of the contact position may preferably be connected to the ground potential. This is because by keeping the intermediary transfer belt 5 at the ground potential, when the discharging brush 28 electrically discharges the filler, an image charge in the intermediary transfer belt 5 side is escaped to the ground potential to weaken the depositing force of the filler.

Embodiment 3

In Embodiments 1 and 2, the discharging brush 28 was connected to the ground potential. However, to the discharging brush 28, by applying an AC voltage in the form of a rectangular wave or sine wave of 100 Hz or more and 2 kHz or less in frequency and 100 V or more and 5 kV or less in voltage with the ground potential as a center value, the discharging can be executed further effectively in a short time (at high speed).

To the discharging brush 28, the AC voltage of 100 V or more and 5000 V or less (with no DC voltage component) may also be applied. The voltage (Vpp=100 V to 5 kV) and frequency (f=100 Hz to 2 kHz) of the AC voltage to be applied may also be controlled so that they becomes higher with a lower humidity. As a result, by effecting the discharging by the discharging brush 28 more aggressively, it is possible to reliably lower the depositing force of the filler onto the intermediary transfer belt 5.

Embodiment 4

Figure 10:
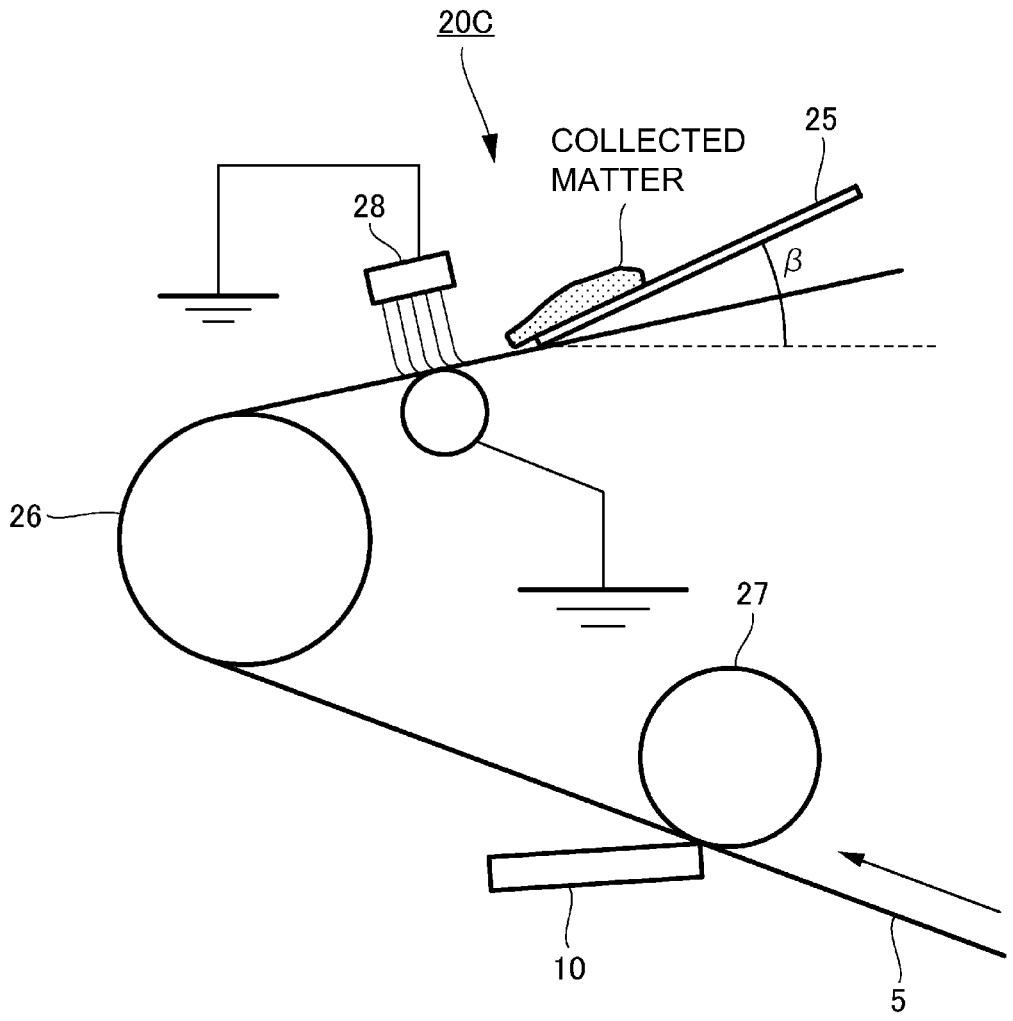
FIG. 10 is an illustration of a structure of a belt cleaning device in Embodiment 4.
Figure 11:
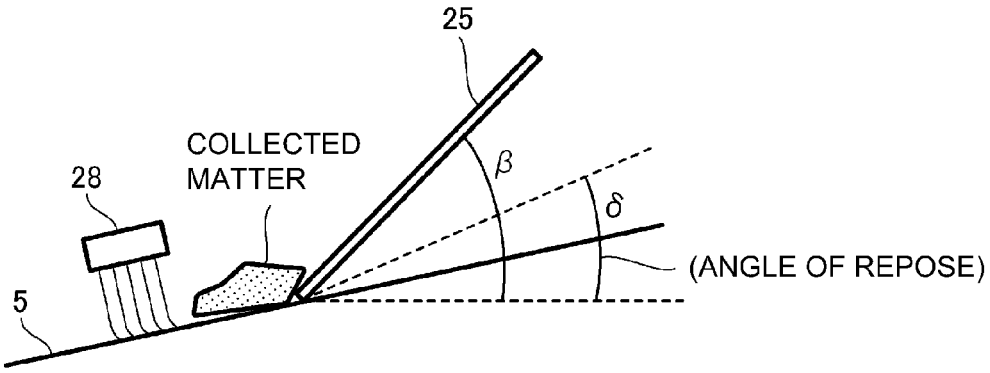
FIGS. 11(*a*) and 11(*b*) are illustrations of a relationship between an inclination of the resin blade and an angle of repose of the particulate matter.
Figure 11:
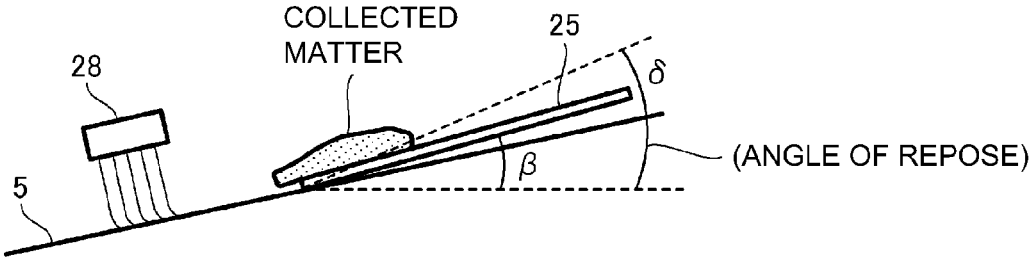

FIG. 10 is an illustration of a structure of a belt cleaning device 20C in Embodiment 4. FIG. 11 is an illustration of a relationship between a slope of the resin blade 25 and an angle of repose of the filler. In Embodiment 1, the end of the resin blade 25 was contacted to the downward surface of the intermediary transfer belt 5. On the other hand, in this embodiment, the end of the resin blade 25 is contacted to the upward surface of the intermediary transfer belt 5. In this embodiment, the resin blade 25 is provided in contact with the upward surface of the intermediary transfer belt 5, and an inclination angle of contact with respect to the horizontal surface is smaller than the angle of repose of the filler.

As shown in FIG. 10, in this embodiment, the discharging brush 28 and the resin blade 25 were provided in the downstream side of the tension roller 26 with respect to the rotational direction of the intermediary transfer belt 5. The filler which passes through the cleaning blade 10 and which is then moved together with the intermediary transfer belt 5 is electrically discharged by the discharging brush 28 to lower the electrostatic attraction force to the intermediary transfer belt 5, and thereafter the filler is scraped off by the resin blade 25 and is deposited on the resin blade 25. The filler collected from the intermediary transfer belt 5 by the resin blade 25 cannot fall in the direction of gravitation different from the case of Embodiment 1 and therefore the filler is pushed up and gradually deposited on the resin blade 25.

In this case, there is a need to set an inclination angle β of the resin blade 25 with respect to the horizontal direction at an angle which is not more than an angle of repose δ of the filler. When the angle of repose δ of the filler was measured by using a powder tester manufactured by Hosokawa Micron Corp., the angle of repose δ was about 40 degrees. The inclination angle β of the resin blade 25 is changed and the continuous image formation of 100,000 sheets is executed, and then a filler accumulation state (presence or absence of stagnation) and the presence or absence of an occurrence of improper cleaning after the end of the image formation were evaluated.

TABLE 2

| β | Stagnation | Improper Cleaning |
|---|---|---|
| 10 | No | No |
| 20 | No | No |
| 30 | No | No |
| 40 | No | No |
| 50 | Yes | Yes |
| 60 | Yes | Yes |

As shown in Table 2, in the case where the inclination angle β of the resin blade 25 is larger than the angle of repose δ=40 degrees of the filler, the filler was stagnated on the intermediary transfer belt 5 and the passing through of the toner was generated.

As shown in (a) of FIG. 11, in the case where the inclination angle β of the resin blade 25 is larger than the angle of repose δ of the filler, the filler accumulated on the intermediary transfer belt 25 is broken to be scattered on the intermediary transfer belt 5. The filler is not readily raised on the resin blade 25 and is stagnated on the intermediary transfer belt 5 between the discharging brush 28 and the resin blade 25. When the filler-stagnated state is continued, the filler passing through the resin blade 25 is increased and is moved together with the intermediary transfer belt 5, so that the filler is fixed and grows on the blade edge of the cleaning blade 10 and thus the passing-through of the toner is generated.

As shown in (b) of FIG. 11, in the case where the inclination angle δ of the resin blade 25 is smaller than the angle of repose β of the filler, the filler collected by the resin blade 25 is raised on the resin blade 25. For this reason, even when the image formation sheet number of 100,000 sheets is accumulated, the filler is not fixed to the blade edge of the cleaning blade 10, so that a stable cleaning performance such that the passing-through of the toner is not generated is maintained.

Comparative Embodiment 2

Figure 12:
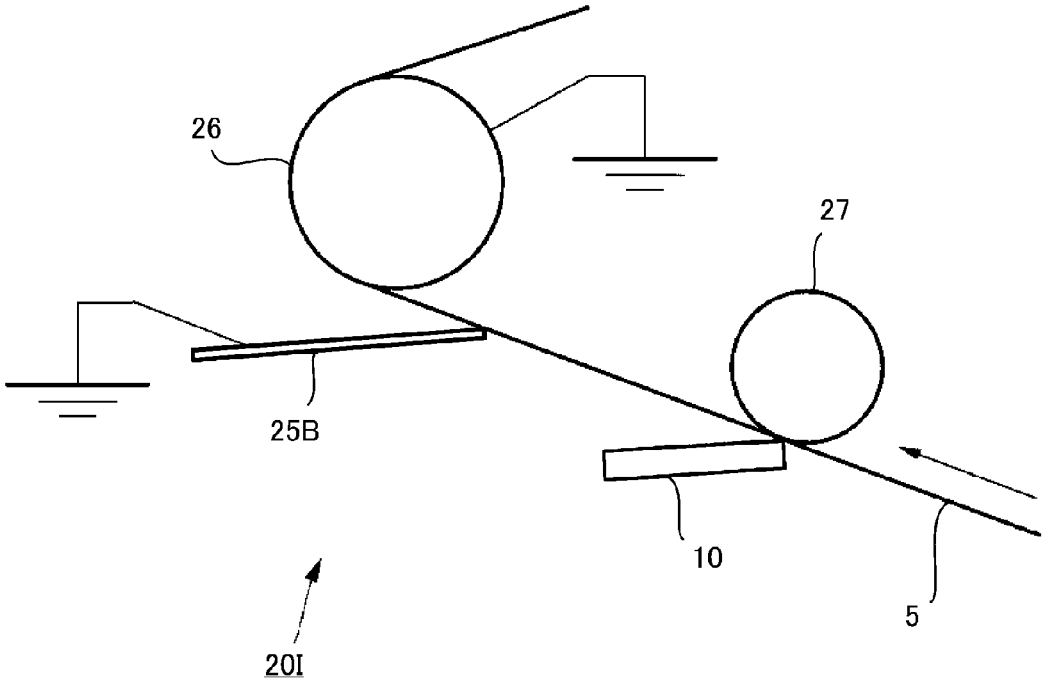
FIGS. 12, 13, 14, 15 and 16 are illustrations of structures of belt cleaning devices in Comparative Embodiment 2 and Embodiments 5, 6, 7 and 8, respectively.

FIG. 12 is an illustration of a structure of a belt cleaning device 20I in Comparative Embodiment 2. In Embodiment 1, the filler on the intermediary transfer belt 5 was electrically discharged in the upstream side of the resin blade 25. On the other hand, in the belt cleaning device 20I in Comparative Embodiment 2, the scraping-off of the filler was executed concurrently with the discharging of the filler by using an electroconductive metal blade 25B, and whether or not an electric discharging effect similar to that in Embodiment 1 was obtained was verified.

As shown in FIG. 12, the metal blade 25B formed with a 100 μm-thick electroconductive stainless steel thin plate material is disposed at the same position as that of the resin blade 25 in Embodiment 1 in the downstream side of the cleaning blade 10 while setting the penetration amount with respect to the intermediary transfer belt 5 at 2 mm. The metal blade 25B was connected to the ground potential.

Similarly as in Embodiment 1, when the continuous image formation of 100 sheets was effected in the low humidity environment including room temperature of 20° C. and the humidity of 5%, the passing-through of the toner was generated. The filler collection was confirmed at the metal blade 25B, but fixing and growth of the filler was confirmed at the blade edge of the cleaning blade 10.

Therefore, with respect to each of the filler immediately after passing through the cleaning blade 10, the filler collected on the metal blade 25B and the filler passing through the metal blade 25B, sampling was made similar as in Comparative Embodiment 1 and then its charge amount Q/M was individually measured.

(1) Average charge amount of filler passing through cleaning blade 10: about −25 μC/g (2) Average charge amount of filler collected on metal blade 25B: about −10 μC/g (3) Average charge amount of filler passing through metal blade 25B: about −30 μC/g As a result, it was confirmed that even when the metal blade 25B was grounded, the electric discharging effect was insufficient and thus the filler which was not completely electrically discharged and which had the high charge amount Q/M passed through the metal blade 25B. When the image formation was further repeated, the passing-through of the toner was generated.

It was confirmed that the filler with the high charge amount Q/M was moved together with the intermediary transfer belt 5 and then was fixed and grew on the blade edge of the cleaning blade 10. The filler moved together with the intermediary transfer belt 5 is not easily removed by the cleaning blade 10. However, it was confirmed that when the fixing was generated on the blade edge of the cleaning blade 10, the filler was accumulated with the fixed agglomeration cluster as the starting point and then grew to an agglomeration cluster such that it generated the passing-through of the toner.

Embodiment 5

Figure 13:
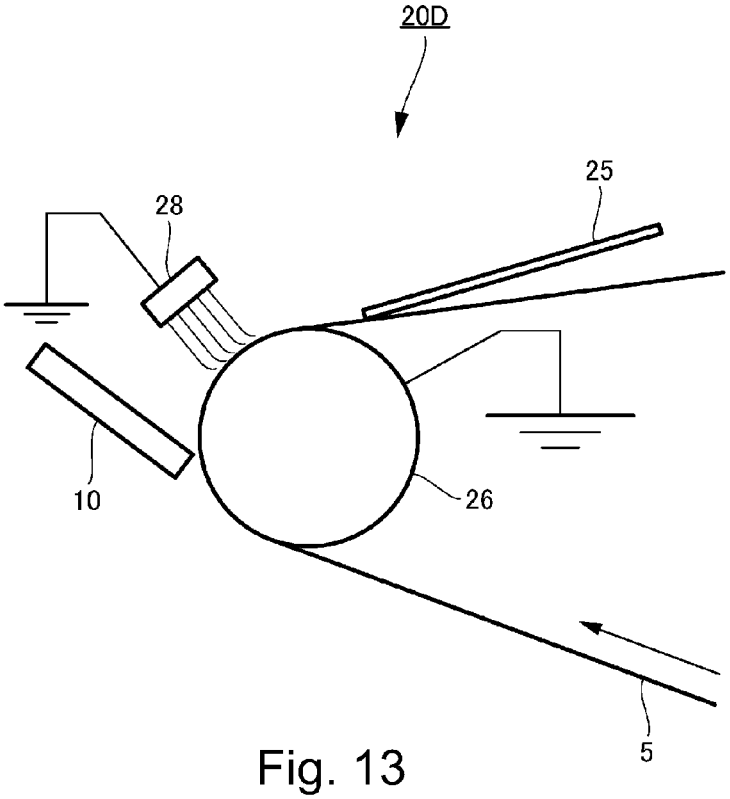

FIG. 13 is an illustration of a structure of a belt cleaning device 20D in Embodiment 5.

As shown in FIG. 13, the intermediary transfer belt 5 which is the example of the belt member is provided by being wound about the tension roller 26, which is the example of the electroconductive supporting roller, with a predetermined angle. The cleaning blade 10, the discharging brush 28 and the resin blade 25 are contacted to the intermediary transfer belt 5 supported by the tension roller 26.

In a belt cleaning device 20D in this embodiment, the intermediary transfer belt 5 was supported by only the tension roller 26 for cleaning the intermediary transfer belt 5. The tension roller 26 alone had two functions as an opposite roller for ensuring the nip pressure of the cleaning blade 10 and as an opposite roller for ensuring the contact pressure with the discharging brush 28 and for ensuring the charge transfer path. The cleaning blade 10, the resin blade 25 and the discharging brush 28 are the same as those in Embodiment 1 and therefore will be omitted from description.

The belt cleaning device 20D in Embodiment 5 was mounted in the image forming apparatus 100 and was subjected to observation of the cleaning blade 10 and evaluation of the passing-through of the toner in each of the stages of the continuous image formation by using the above-described recording material with the large generation amount of the filler. The continuous image formation of 5,000 sheets was effected under the environment, of room temperature of 20° C. and the humidity of 5%.

As a result, it was confirmed that the filler principally containing heavy calcium carbonate was stably collected continuously and was not fixed and accumulated at the blade edge of the cleaning blade 10. Further, the continuous image formation was effected until 200,000 sheets but the filler was not accumulated at the blade edge of the cleaning blade 10 and the passing-through of the toner was not generated until final image formation, so that a good cleaning performance was maintained.

Further, when the filler was sampled in front of and behind the discharging brush 28 and then its charge amount Q/M was measured to check the discharging effect, the average charge amount before passing the discharging brush 28 was −25 μC/g, whereas the average charge amount after passing the discharging brush 28 was about −4 μmC/g. That is, the discharging effect by the discharging brush 28 was confirmed. It was confirmed that the filler increased in charge when it passed through the cleaning blade 10 and was electrically discharged by the discharging brush 28 to be lowered in electrostatic attraction force with respect to the intermediary transfer belt 5. For this reason, it would be considered that the scraping-off of the filler by the resin blade 25 becomes easy and thus the filler moved together with the intermediary transfer belt 5 is decreased.

According to the belt cleaning device 20D in Embodiment 5, there is no need to provide the electroconductive opposite rollers (27 and 30 in FIG. 7) which are disposed inside the intermediary transfer belt 5 and which are connected to the ground potential, and therefore the belt cleaning device 20D is advantageous in terms of downsizing and weight reduction of the image forming apparatus.

Embodiment 6

Figure 14:
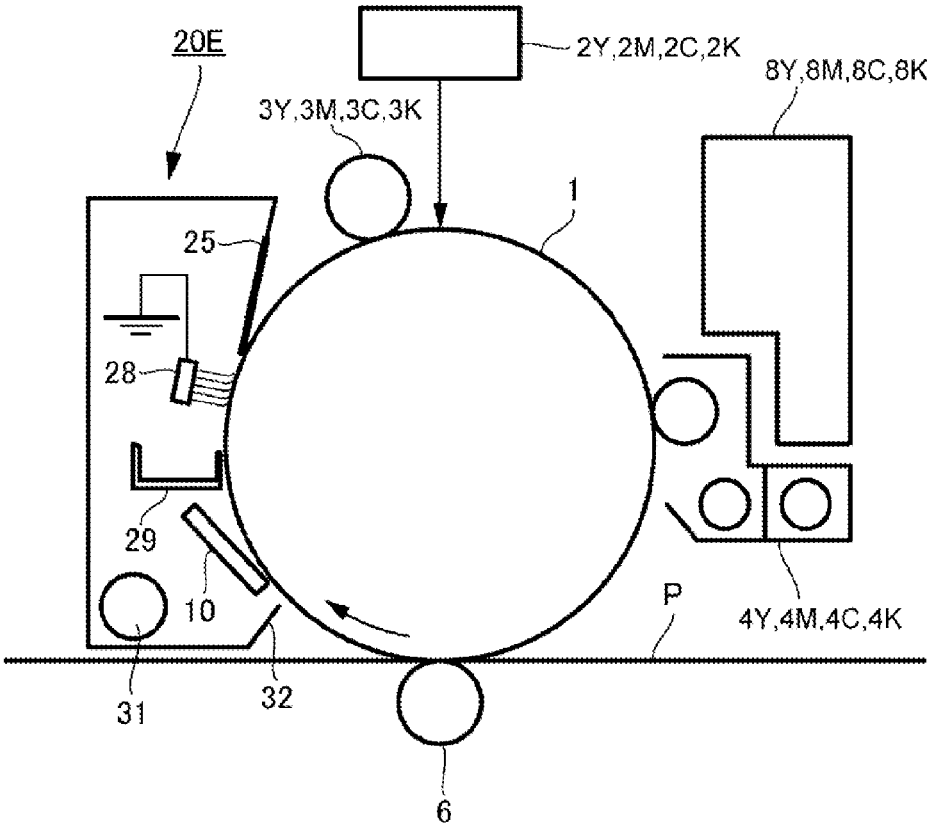

FIG. 14 is an illustration of a structure of a belt cleaning device 20E in Embodiment 6. FIG. 15 is an illustration of a manner of use of an edge of the resin blade 25 at a cutting surface.

In Embodiment 1, the filler moved together with the intermediary transfer belt 5 was collected by using the discharging brush 28 and the resin blade 25. On the other hand, in Embodiment 6, the filler moved together with a photosensitive drum 1 is collected by using the discharging brush 28 and the resin blade 25.

As shown in FIG. 14, the drum cleaning device 20E collects a transfer residual toner, by the cleaning blade 10, which is transferred from the recording material P onto the photosensitive drum 1 at a nip between the photosensitive drum 1 and a transfer roller 6. The filler was passes through the cleaning blade 10 and which is then moved together with the photosensitive drum 1 is electrically discharged in contact with the discharging brush 28 connected to the ground potential, so that the depositing force of the filler on the photosensitive drum 1 is weakened.

The resin blade 25 removes, from the photosensitive drum 1, the filler which is electrically discharged and of which the depositing force is weakened. The resin blade 25 is obtained by cutting a 200 μm-thick sheet material of PET resin into a size of 20 mm in width and 340 mm in length. As shown in FIG. 15, the resin blade 25 is attached to the drum cleaning device 20E so that a burr portion after the cutting is positioned in a side opposite from the photosensitive drum 1.

Embodiment 7

In Embodiment 1, the belt cleaning device 20 for the intermediary transfer belt 5 was described. In this embodiment, a belt cleaning device for a recording material conveying belt or a transfer belt will be described. With respect to the transfer belt which is an example of a recording material conveying member, the toner image is transferred from the image bearing member onto the recording material carried on the transfer belt. The cleaning blade is contacted to the surface of the transfer belt after the recording material on which the toner image is transferred is separated. The discharging brush constituted similarly as in Embodiment 1 electrically discharges the filler which passes through the cleaning blade and which is then deposited on the surface of the transfer belt. The resin blade constituted similarly as in Embodiment 1 is formed in a thickness smaller than that of the cleaning blade by using a material having a higher elastic coefficient than that of the cleaning blade. The resin blade is disposed in contact with the surface of the transfer belt after passing through the discharging brush at its end toward the upstream side of the rotational direction.

The recording material conveying belt or the transfer belt causes, in some cases, transfer of the filler from the recording material when it passes through a transfer portion of the toner image while carrying the recording material. Also with respect to the filler deposited on the recording material conveying belt or the transfer belt, similarly as in Embodiment 1, the cleaning blade 10, the discharging brush 28 and the resin blade 25 are sequentially disposed from the upstream side toward the downstream side, so that the filler can be removed.

Embodiment 8

Figure 16:
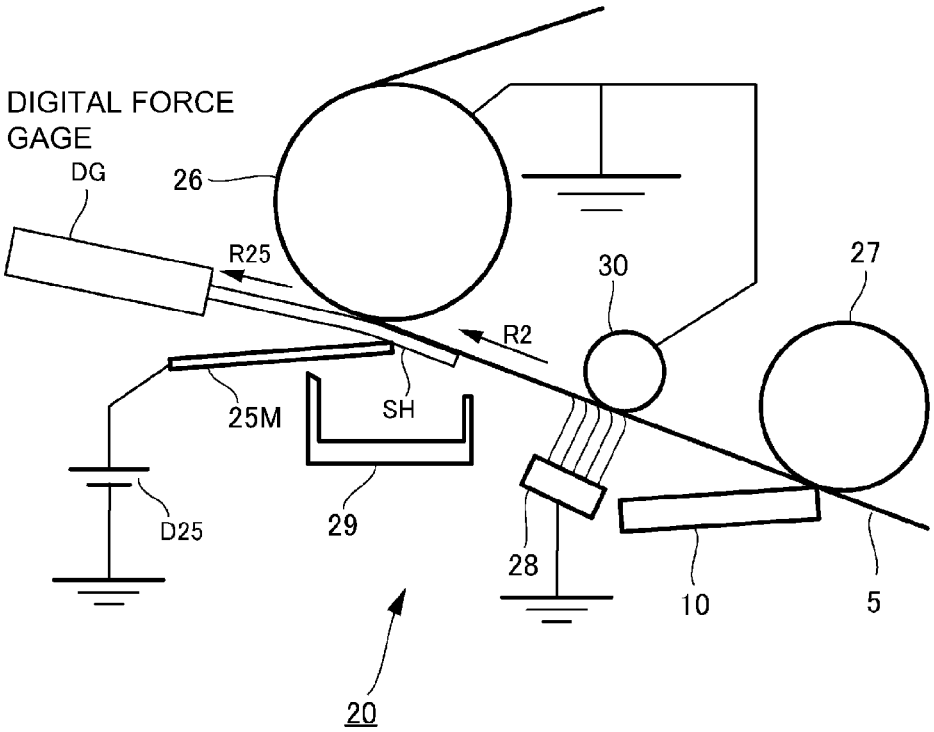
Figure 17:
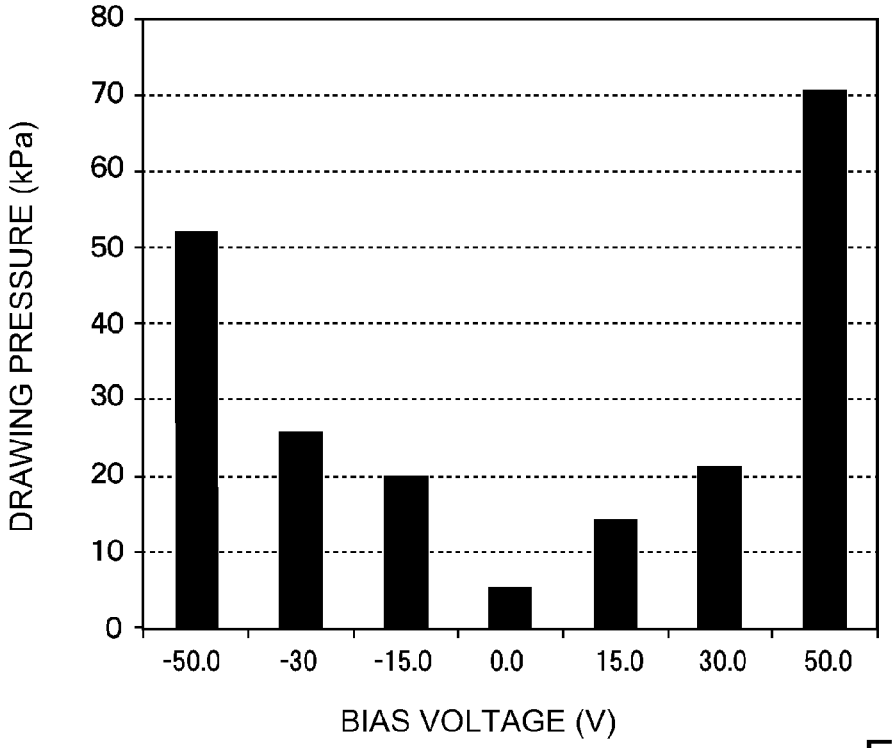
FIG. 17 is an illustration of relationships between a bias voltage applied to a metal blade and a contact pressure.

FIG. 16 is an illustration of a structure of a belt cleaning device 20 in Embodiment 8. FIG. 17 is an illustration of a relationship between a bias voltage to be applied to a metal blade 25M and a contact pressure. As shown in FIG. 16, this embodiment is substantially the same as Embodiment 1 in constitution except for the metal blade 25M and a power source D25. For this reason, in FIG. 16, constituent elements common to Embodiments 1 and 8 are represented by common reference numerals or symbols and will be omitted from redundant description.

As shown in FIG. 16, the metal blade 25M which is the example of the thin plate-like member is formed of an electroconductive material having a thickness of 50 μm or more and 100 μm or less. The power source D25 which is an example of a power source applies, to the metal blade 25M, a bias voltage of 10 V or more and 50 V or less as an absolute value of a voltage value.

In a low temperature environment of 20° C. or less in temperature as the operation environment, the charge amount of the filler moved together with the intermediary transfer belt 5 becomes high compared with that in the normal temperature and normal humidity environment and therefore it becomes difficult to remove the filler by using the resin blade 25. In the image forming apparatus 100 in Embodiment 1 shown in FIG. 7, when the charge amount of the filler before passing through the discharging brush 28 was actually measured, the charge amount was −25 μC/g in the normal temperature and normal humidity environment of 23° C. and 50% and on the other hand, the charge amount was −40 μC/g in the low temperature environment of 18° C. and 50%. Further, in the low temperature environment of 18° C. and 50%, also after passing through the discharging brush 28, an average charge amount of the filler was −15 μC/g which was high. Then, when the continuous image output was continued under the low temperature environment of 18° C. and 50%, the passing-through of the toner was generated about 2000 sheets and it was confirmed that the aggregate of the filler was formed at the cleaning blade edge at that time, and therefore it was considered that the growth of the aggregate of the filler caused the passing-through of the toner. That is, in the low temperature environment, there is a possibility that the passing through of the toner cannot be sufficiently avoided by only the discharging brush 28 and the resin blade 25 in Embodiment 1.

Therefore, as shown in FIG. 16, an experiment in which the bias voltage was applied by using the metal blade 25M in place of the resin blade 25 was conducted. The metal blade 25M was a 150 μm-thick electroconductive stainless steel plate, and the penetration amount of the end of the metal blade 25M with respect to the intermediary transfer belt 5 was 1.5 mm.

The presence or absence of the occurrence of the passing-through of the toner was checked by performing the continuous image output while applying a plurality of bias voltages to the metal blade 25M in the low temperature environment of 18° C. and 50%. As a result, it was confirmed that when the bias voltage applied to the metal blade 25M was 30 V or more, the passing-through of the toner was not generated even when the continuous image output of 200,000 sheets or more was continued, and thus the filler was accumulated at the end of the metal blade 25M.

As shown in FIG. 17, the contact pressure of the metal blade 25M becomes larger with a larger absolute value of the bias voltage. It would be considered that an electrostatic force is generated between the metal blade 25M and the intermediary transfer belt 5 by applying the bias voltage to the metal blade 25M and thus the contact pressure at the end of the metal blade 25M is correspondingly increased. FIG. 17 shows a measurement result of measurement of the contact pressure through drawing pressure measurement during application of the bias voltage to the metal blade 25M.

In the drawing pressure measurement, an end of a test piece SH of a PET sheet of 10 mm in width, 50 mm in length and 100 μm in thickness was mounted in a digital force gage DG, and the other end of the test piece SH was sandwiched between the intermediary transfer belt 5 and the metal blade 25M. The PET sheet test piece SH was pulled out in an arrow R25 direction, and then an output value of the digital force gap DG was read. The drawing pressure was measured by regarding a load exerted on the digital force gauge via the PET sheet test piece SH as a pressure corresponding to the contact pressure of the metal blade 25M.

Next, the continuous image output was performed by changing the bias voltage applied to the metal blade 25M, so that a continuous output sheet number in which the passing-through of the toner was generated was checked at every bias voltage. An experimental result is shown in Table 3. In Table 3, in the case where the passing-through of the toner was not generated until 200,000 sheets, the experiment was ended at that time, and the passing-through of the toner was evaluated as "o". In the case where the passing-through of the toner was generated at less than 200,000 sheets, the passing-through of the toner was evaluated as "x", and the continuous output sheet number at that time was also shown. In Table 3, rubbing damage was evaluated by the presence or absence of an occurrence of a black stripe-like defective image. This is because the rubbing damage is generated on the surface of the intermediary transfer belt 5 along a conveyance direction when the metal blade 25M is strongly contacted to the intermediary transfer belt 5, and when a depth of the rubbing damage reaches 2 μm or more, the black stripe-like defective image is generated at a position of the rubbing damage of a halftone image. In the case where the defective image was generated, the rubbing damage was evaluated as "x", and in the case where the defective image was not generated, the rubbing damage was evaluated as "o".

TABLE 3

| Bias | Passing-through | | Rubbing damage |
|---|---|---|---|
| Grounded | 5000 sheets | x | o |
| +10 V | 18000 sheets | x | o |
| +20 V | 25000 sheets | x | o |

TABLE 3-continued

| Bias | Passing-through | | Rubbing damage |
|---|---|---|---|
| +30 V | 200000 sheets | ○ | ○ |
| +50 V | 200000 sheets | ○ | ○ |
| +70 V | 200000 sheets | ○ | x |
| +100 V | 200000 sheets | ○ | x |
| −30 V | 200000 sheets | ○ | ○ |
| −50 V | 200000 sheets | ○ | ○ |
| −70 V | 200000 sheets | ○ | x |
| −100 V | 200000 sheets | ○ | x |

As shown in Table 3, in Embodiment 8, the passing-through of the toner is not generated at the bias voltage of 30 V or more (absolute value), but at the bias voltage of 70 V or more (absolute value), the rubbing damage on the intermediary transfer belt 5 does not satisfy the evaluation criterion. For this reason, an effect in this embodiment is not obtained by simply increasing only the bias voltage.

Further, with respect to the polarity of the bias voltage, a similar effect is achieved in either case where the polarity is positive or negative, and therefore it would be considered that the electrically discharged filler can be dealt with the metal blade 25M, of which the contact pressure is electrostatically enhanced, irrespective of the polarity of the bias voltage.

Embodiment 9

As shown in FIG. 1, the secondary transfer roller 24 is disposed in contact with the intermediary transfer belt 5 and to which the voltage of the opposite polarity to the toner charge polarity is applied, so that the toner image is transferred onto the recording material.

As shown in FIG. 16, the power source D25 is capable of applying the same polarity bias voltages different in absolute value in a switching manner. The power source D25 applies a first bias voltage to the metal blade 25M in the case where the voltage of the opposite polarity to the toner charge polarity is applied to the secondary transfer roller 24. On the other hand, the power source D25 applies a second bias voltage to the metal blade 25M in the case where a voltage of an identical polarity to the toner charge polarity is applied to the secondary transfer roller 24. The absolute value of the first bias voltage is smaller than that of the second bias voltage.

As shown in FIG. 1, the amount of the filler which reaches the cleaning blade 10 during the continuous image output is larger during the image output than during image adjustment. The amount of the filler transferred onto the intermediary transfer belt 5 in a secondary transfer roller cleaning sequence during the image adjustment becomes large compared with that during the continuous image formation (image output). This is because during the image output, at the time of the secondary transfer of the toner image, the filler is transferred from the recording material, in a side facing the intermediary transfer belt 5, onto the intermediary transfer belt 5, and on the other hand, during the image adjustment, at the time of the secondary transfer of the toner image, the filler accumulated on the secondary transfer roller 24 in a process of the continuous image output is collectively discharged with the cleaning sequence of the secondary transfer roller 24.

For the image adjustment, a sequence in which a toner band is supplied to the cleaning blade 10 of the belt cleaning device 20 is executed also for detecting a density of a patch toner image for density detection formed on the intermediary transfer belt 5. The toner band supplying sequence is executed while enlarging an image interval every continuous image output of 250 sheets. During the image adjustment, after the patch toner image (toner band) for density detection transferred on the intermediary transfer belt 5 passes through the secondary transfer roller 24, the secondary transfer roller cleaning sequence is executed. In the secondary transfer roller cleaning sequence, the toner deposited on the secondary transfer roller 24 is electrostatically transferred onto the intermediary transfer belt 5 and then is collected by the belt cleaning device 20. In the secondary transfer roller cleaning sequence, the positive-polarity bias voltage is applied to the secondary transfer roller 24 correspondingly to one-full-circumference so that a transfer current of 20 μA flows, and thereafter the negative-polarity bias voltage is applied to the secondary transfer roller 24 correspondingly to one-full-circumference so that a transfer current of −20 μA flows. When the negative-polarity bias voltage is applied to the secondary transfer roller 24, the filler accumulated in a period of the continuous image output is transferred from the secondary transfer roller 24 onto the intermediary transfer belt 5.

Therefore, by conducting the following experiment, the filler transferred onto the intermediary transfer belt 5 in the secondary transfer roller cleaning sequence was quantified.

(1) The drive of the intermediary transfer belt 5 is stopped immediately after the application of the negative-polarity bias voltage in the secondary transfer roller cleaning sequence, and then the filler is sampled by applying a transparent adhesive tape onto the portion of the intermediary transfer belt 5 where the negative-polarity bias voltage is applied.

(2) The transparent adhesive tape on which the filler is adhered is applied onto black paper and is then subjected to lamination, and thereafter a filler distribution image is captured by a flat head scanner.

(3) The filler portion constitutes a white portion and therefore the captured image is subjected to binarization to calculate an area of the white portion, i.e., an area of the filler portion.

By using a similar procedure, the filler transferred onto the intermediary transfer belt 5 during the continuous image formation was quantified.

(1) The drive of the intermediary transfer belt 5 is stopped immediately after the recording material passes through the secondary transfer roller 24, and then the filler is sampled by applying the transparent adhesive tape onto a portion where the recording material overlaps with the intermediary transfer belt 5.

In steps (2) and (3), the same operations as those in the above steps (2) and (3) were performed.

As a result, it was confirmed that the filler accumulated on the secondary transfer roller 24 was collectively transferred on the intermediary transfer belt 5 during the secondary transfer roller cleaning sequence. When the area of the filler sampled during normal continuous image formation was 1, an areal ratio of the filler sampled during the secondary transfer roller cleaning sequence was 3 to 8.

Next, in the constitution of Embodiment 8 shown in FIG. 16, the bias voltage applied to the metal blade 25M was changed between during the normal continuous image formation and during the secondary transfer roller cleaning sequence, and then the presence or absence of the occurrence of each of the passing-through of the toner and the rubbing damage was evaluated. An experimental result of various combinations of bias voltages is shown in Table 4.

TABLE 4

| Applied bias | | | | Rubbing |
|---|---|---|---|---|
| Normal | Cleaning | Passing-through | | damage |
| Grounded | Grounded | 5000 sheets | x | ○ |
| Grounded | +10 V | 15000 sheets | x | ○ |
| Grounded | +20 V | 18000 sheets | x | ○ |
| Grounded | +30 V | 30000 sheets | x | ○ |
| Grounded | +50 V | 60000 sheets | x | ○ |
| +10 V | +20 V | 80000 sheets | x | ○ |
| +10 V | +30 V | 200000 sheets | ○ | ○ |
| +10 V | +50 V | 200000 sheets | ○ | ○ |
| +10 V | +70 V | 200000 sheets | ○ | ○ |
| +20 V | +10 V | 20000 sheets | x | ○ |
| +20 V | +20 V | 25000 sheets | x | ○ |
| +20 V | +30 V | 200000 sheets | ○ | ○ |
| +20 V | +50 V | 200000 sheets | ○ | ○ |
| +30 V | +10 V | 40000 sheets | x | ○ |
| +30 V | +30 V | 200000 sheets | ○ | ○ |
| +30 V | +50 V | 200000 sheets | ○ | ○ |
| +50 V | +10 V | 50000 sheets | x | x |
| +50 V | +30 V | 200000 sheets | ○ | x |
| +50 V | +50 V | 200000 sheets | ○ | x |

As shown in Table 4, in the combination in which the bias voltage during the continuous image formation is less than that during the secondary transfer roller cleaning sequence, the continuous image formation sheet number until the passing-through of the toner is generated is increased, so that also the rubbing damage of the intermediary transfer belt is not readily generated. On the other hand, in the combination in which the bias voltage during the continuous image formation is not less than that during the secondary transfer roller cleaning sequence, the continuous image formation sheet number until the passing-through of the toner is generated is decreased, so that also the rubbing damage of the intermediary transfer belt is liable to occur.

The reason therefor may be considered as follows. In the secondary transfer roller cleaning sequence, the amount of the filler transferred onto the intermediary transfer belt 5 is larger than that during the continuous image formation and therefore there is a need to increase the contact pressure by increasing the bias voltage for removing the filler. However, the secondary transfer roller cleaning sequence is executed at a low frequency of once per continuous image formation of 250 sheets and a large amount of the filler is deposited on the surface of the intermediary transfer belt 5 and therefore the rubbing damage is not readily generated on the intermediary transfer belt 5 even when the contact pressure of the metal blade 25M is increased. On the other hand, the frequency of the continuous image formation is high and the amount of the filler deposited on the surface of the intermediary transfer belt 5 is small, and therefore when a filler removing effect is enhanced by applying a high bias voltage, the rubbing damage is liable to occur on the intermediary transfer belt 5.

Incidentally, in Embodiment 9, the setting condition of the bias voltage applied under the condition of the low temperature and normal humidity environment of 18° C. and 50% was described. However, in a further low temperature environment, the charge amount of the filler is further increased and therefore the value of the voltage applied to the metal blade 25M may desirably be set so that the voltage value during the continuous image formation is smaller than that during the secondary transfer roller cleaning sequence. As a result, it is possible to avoid the occurrence of the passing-through of the toner without generating the rubbing damage on the intermediary transfer belt 5.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 041284/2012 and 025455/2013 filed Feb. 28, 2012 and Feb. 13, 2013, respectively, which are hereby incorporated by reference.

What is claimed is:

1. An image forming apparatus comprising:

a rotatable image bearing member for bearing a toner image;

a toner image forming portion for forming the toner image on said image bearing member;

a transfer member for electrostatically transferring the toner image from said image bearing member, on which the toner image is borne, onto a recording material at a transfer portion;

a cleaning blade, provided downstream of the transfer portion and upstream of said toner image forming portion with respect to a rotational direction of said image bearing member, for removing a toner in contact with a surface of said image bearing member;

a discharging member, provided downstream of said cleaning blade and upstream of said toner image forming portion with respect to the rotational direction of said image bearing member, for electrically discharging said image bearing member; and a thin plate-like member provided downstream of said discharging member and upstream of said toner image forming portion with respect to the rotational direction of said image bearing member, wherein an end of said thin plate-like member is contacted to a surface of said image bearing member toward an upstream side with respect to the rotational direction of said image bearing member.

2. An image forming apparatus according to claim 1, wherein said thin plate-like member is formed in a thickness smaller than that of said cleaning blade by using a material having an elasticity coefficient higher than that of said cleaning blade.

3. An image forming apparatus according to claim 1, wherein said discharging member includes a brush contacted to an outer peripheral surface of said image bearing member.

4. An image forming apparatus according to claim 3, wherein said image bearing member is an intermediary transfer belt formed in an endless shape.

5. An image forming apparatus according to claim 4, further comprising a roller which is provided at a position where said roller opposes the brush via the intermediary transfer belt and which is in contact with an inner peripheral surface of the intermediary transfer belt.

6. An image forming apparatus according to claim 5, wherein the brush is electroconductive and is connected to a ground potential.

7. An image forming apparatus according to claim 5, further comprising a power source for applying a voltage to the brush, wherein the brush is electroconductive and to the brush, the voltage including an AC component of 100 Hz or more and 2 kHz or less in frequency and 100 V or more and 5 kV or less in maximum amplitude voltage is applied.

8. An image forming apparatus according to claim 4, further comprising a roller which is provided at a position where said roller opposes said discharging brush via the intermediary transfer belt and which is in contact with an inner peripheral surface of the intermediary transfer belt, wherein said cleaning blade is urged toward said roller.

9. An image forming apparatus according to claim 4, further comprising a roller which is provided at a position where said roller opposes said thin plate-like member via the intermediary transfer belt and which is in contact with an inner peripheral surface of the intermediary transfer belt, wherein said thin plate-like member is urged toward said roller.

10. An image forming apparatus according to claim 4, further comprising a roller which is provided at a position where said roller opposes said cleaning blade and said thin plate-like member via the intermediary transfer belt and which is in contact with an inner peripheral surface of the intermediary transfer belt, wherein said thin plate-like member is urged toward said roller.

11. An image forming apparatus according to claim 10, wherein said roller is electroconductive and is connected to a ground potential.

12. An image forming apparatus according to claim 4, wherein the end of said thin plate-like member is contacted to the outer peripheral surface of the intermediary transfer belt in a region where a normal direction of the outer peripheral surface is directed upward from a horizontal surface.

13. An image forming apparatus according to claim 9, wherein said thin plate-like member is disposed so that an angle formed between its thin plate-like surface and the horizontal surface is smaller than an angle of repose of heavy calcium carbonate.

14. An image forming apparatus according to claim 4, wherein the end of said thin plate-like member is contacted to the outer peripheral surface of the intermediary transfer belt in a region where a normal direction of the outer peripheral surface is directed downward from a horizontal surface, and wherein said image forming apparatus further comprises an accommodating portion, provided vertically below said thin plate-like member, for accommodating a falling object falling from the neighborhood of the end of said thin plate-like member.

15. An image forming apparatus according to claim 1, wherein said thin plate-like member is formed with a sheet of polyethylene terephthalate having a thickness of 50 μm or more and 100 μm or less.

16. An image forming apparatus according to claim 1, further comprising a power source for applying a voltage to said thin plate-like member, wherein said thin plate-like member is formed of an electroconductive material in a thickness of 50 μm or more and 100 μm or less, and wherein the voltage of said power source applied to said thin plate-like member is 10 V or more and 50 V or less in absolute value.

17. An image forming apparatus according to claim 16, further comprising a controller for controlling the voltage of said power source, wherein said controller is capable of switching the voltage applied to the thin plate-like member into a plurality of voltage values.

18. An image forming apparatus according to claim 17, wherein said transfer member is a transfer roller, and wherein said controller contacts the voltage of said power source so that a first voltage is applied to said thin plate-like member when a voltage of an opposite polarity to a charge polarity of the toner is applied to the transfer roller and so that a second voltage smaller in absolute value than the first voltage is applied to said thin plate-like member when a voltage of an identical polarity to the charge polarity of the toner is applied to the transfer roller.

19. An image forming apparatus according to claim 1, wherein said image bearing member is a photosensitive member.

* * * * *